US008321976B1

(12) United States Patent
Edgerton

(10) Patent No.: US 8,321,976 B1
(45) **Date of Patent: *Dec. 4, 2012**

(54) HEIGHT ADJUSTABLE APPARATUS WITH CONTROL ARM

(75) Inventor: John Edgerton, Omro, WI (US)

(73) Assignee: GF Health Products, Inc., Atlanta, GA (US)

( * ) Notice: Subject to any disclaimer, the term of this patent is extended or adjusted under 35 U.S.C. 154(b) by 1122 days.

This patent is subject to a terminal disclaimer.

(21) Appl. No.: 12/206,522

(22) Filed: Sep. 8, 2008

Related U.S. Application Data

(63) Continuation-in-part of application No. 12/005,467, filed on Dec. 26, 2007, now Pat. No. 7,849,538, which is a continuation-in-part of application No. 11/173,491, filed on Jun. 30, 2005, now Pat. No. 7,421,748.

(51) Int. Cl.
*A47B 7/00* (2006.01)

(52) U.S. Cl. ..... 5/611; 5/11; 5/86.1

(58) Field of Classification Search ..... 5/11, 611, 5/86.1; 108/147, 144.11, 145; 254/418, 254/2 C, 93 I, 123; 296/20
See application file for complete search history.

(56) References Cited

U.S. PATENT DOCUMENTS

| | | | | |
|---|---|---|---|---|
| 3,003,159 | A | 10/1961 | Hebert et al. | |
| 4,062,075 | A | 12/1977 | Stern et al. | |
| 5,303,437 | A | 4/1994 | Hung | |
| 5,544,375 | A | 8/1996 | Urness et al. | |
| 5,720,059 | A * | 2/1998 | Allevato et al. | 5/610 |
| 6,161,236 | A * | 12/2000 | Carroll | 5/618 |
| 6,230,344 | B1 * | 5/2001 | Thompson et al. | 5/611 |
| 6,363,556 | B1 | 4/2002 | Krauska et al. | |
| 6,405,393 | B2 | 6/2002 | Megown | |
| 6,505,362 | B1 * | 1/2003 | Scipio | 5/118 |
| 6,851,144 | B2 | 2/2005 | Wang | |
| 6,868,567 | B2 | 3/2005 | Edgerton | |
| 7,013,510 | B1 * | 3/2006 | Johnson | 5/611 |
| 2002/0066142 | A1 | 6/2002 | Osborne et al. | |
| 2006/0021143 | A1 | 2/2006 | Lemire | |
| 2006/0026762 | A1 | 2/2006 | Hornbach et al. | |
| 2006/0123545 | A1 | 6/2006 | Johnson | |

* cited by examiner

*Primary Examiner* — William Kelleher
(74) *Attorney, Agent, or Firm* — Brannen Law Office, LLC

(57) ABSTRACT

The present invention has a deck supported by at least one parallelogram. When two parallelograms are used, the first has first and second levers and a drag link, and the second has third and fourth levers and a second drag link. Each parallelogram is raised and collapsed with an actuator. The first lever and the fourth lever each have an arm with an interface. The actuators are pivotally and movably connected to the interfaces and pivotally connected to the drag links. The location of the actuators relative the interfaces is controlled with control arms. The control arms have ends that are connected to the respective drag link and each rotates at an offset circular path about a central point of the adjacent levers.

10 Claims, 23 Drawing Sheets

HEIGHT ADJUSTABLE APPARATUS WITH CONTROL ARM

This application is a continuation-in-part of United States Utility Application having Ser. No. 12/005,467 filed on Dec. 26, 2007, now U.S. Pat. No. 7,849,538 which itself is a continuation-in-part of United States Utility Application having Ser. No. 11/173,491 filed on Jun. 30, 2005, now U.S. Pat. No. 7,421,748 the contents of each are hereby incorporated herein by reference.

BACKGROUND OF THE INVENTION

1. Field of the Invention

The present invention relates to an apparatus, such as a bed, having a vertically adjustable deck that is selectably raised and lowered with at least one actuator operating with improved loading characteristics.

2. Description of the Related Art

Typically, height and angle adjustable beds are used by medical institutions, such as hospitals and nursing homes. The beds usually include a bed frame and an articulating mechanism for lowering the bed frame to a low position and raising the bed frame to a high position so that it may be used as a gurney or at any height in between. As a result, a patient can be transferred by merely sliding the patient from one gurney to another or a chair.

It is known to have height and angle adjustable beds that may be lowered to a fully lowered position near the floor; however, such beds usually require a mechanical or hydraulic compression assist mechanism or high-power hydraulic lift mechanisms to lift the bed from the fully lowered position. For example, U.S. Pat. No. 6,405,393 to Megown ("the '393 patent"), the contents of which are hereby incorporated herein reference, discloses a spring assist mechanism that allows a height adjustable bed to rise from a fully lowered position. The '393 patent describes the increase in force necessary to raise the bed from the fully lowered position. This is because as the angle between the linear actuator and the bed frame in the bed shown in the '393 patent approaches zero, the cosine of that angle also approaches zero. As the cosine of the angle approaches zero, the resultant lift component, or vertical component, of the actuator force also approaches zero. The actuator is therefore at a mechanical disadvantage when the cosine of the angle approaches zero. A mechanical or hydraulic compressive assist mechanism may be used to overcome the mechanical disadvantage. However, such components may fail unexpectedly. In addition, when such mechanisms fail, time delay, damage or injury may occur. Thus, it would be desirable to eliminate any need for mechanical and hydraulic compressive assist mechanisms.

A further disadvantage of some existing angle adjustable beds is that they comprise two motors acting in parallel. The additional force of multiple motors acting in parallel can be useful for overcoming the mechanical disadvantage created at the low positions. Yet, use of two motors in parallel can be disadvantageous as the two motors can get out of synchronization. In this regard, either motor may raise or lower a respective end of the bed at a different rate. This could jeopardize the health and safety of any person on the bed. Further, such a drawback could make transport during raising and lowering of the bed impractical and hazardous. Further, while having two motors acting in parallel may be beneficial in overcoming the mechanical disadvantage at the low position, their use can be inefficient.

A still further disadvantage yet of existing angle adjustable beds is that they may require an undesirably large amount of swing to reposition the bed from the lowered position to the raised position. The swing occurs as a result of the support frame of the bed moving forward or rearward relative to the wheels. A large swing is disadvantageous for several reasons. First, having bed frame move forward or rearward relative to the wheels changes the center of gravity of the bed. The larger the swing, the larger the change in the center of gravity of the bed. Second, with the ever increasing pressure to reduce room size and to fit more items into existing rooms, there is a sizable disadvantage to a bed that requires a relatively large amount of swing to raise the bed to the raised position and/or lower the bed to a lowered position.

A still further disadvantage yet of some existing beds is that they are relatively slow to raise the bed from a lowered position to a raised position.

Thus there exists a need for an apparatus such as a bed that solves these and other problems.

SUMMARY OF THE INVENTION

The present invention relates to an apparatus, such as a bed, having a vertically adjustable deck that is selectably raised and lowered with at least one actuator operating with improved loading characteristics.

In one preferred embodiment, the invention has a mainframe and a deck, hereafter referred to collectively as a deck. The deck is supported by an upper portion and a lower portion. The upper portion has a first lever and a second lever. The first lever can have three arms that rotate about a central rotational axis, and can have an interface such as a track, slide or slot in the third arm. The first and second levers can be connected with a drag link. An ear with an interface such as a slot can be at one end of the drag link. The drag link interface can orbit about the first lever central axis in an offset circular path. An actuator can be pivotally and slideably or movably connected to the first lever, in the interface, and pivotally connected to the drag link. In this regard, the actuator is pivotally connected relative to but not directly to the deck. The location of the actuator relative the third arm interface is controlled with a control arm. Movement of the actuator relative the third arm interface can change the effective length of the third arm of the first lever. The control arm has an end that may be movable relative the drag link by being movably positioned within the slot of the ear at one end of the drag link. The angle between the centerline of the third arm interface and the actuator is preferably less than or equal to 90 degrees throughout the actuator stroke. The first lever, the second lever and the drag link partially define sides of a parallelogram.

A second set of levers, comprising third lever and fourth lever, is further connected to the first lever and second lever, respectively. The fourth lever can have three arms that rotate about a central rotational axis, and can have an interface such as a track, slide or slot in the third arm. The third and fourth levers can be connected with a drag link. An ear with a drag link interface such as a slot can be at one end of the drag link. The drag link interface can orbit about the first lever central axis in an offset circular path. An actuator can be pivotally and slideably or movably connected to the fourth lever, at the interface, and pivotally connected to the drag link. In this regard, the actuator is pivotally connected relative to but not directly the castor bases. The location of the actuator relative the third arm interface is controlled with a control arm. Movement of the actuator relative the interface can change the effective length of the third arm of the fourth lever. The control arm has an end that maybe movable relative the drag link by being movably positioned within the slot of the ear at one end of the drag link. The angle between the centerline of the third arm interface and the actuator is preferably less than or equal to 90 degrees throughout the entire actuator stroke. The third lever, fourth lever and the second drag link partially define a second parallelogram.

The first and second parallelograms can operate in opposite rotational directions at equal or near equal speed and in opposed and equal or near equal lateral amounts so that the net effect is a vertical or near vertical rise and lowering of the bed. It is appreciated that in one embodiment, only one set of levers is present and hence only one parallelogram is present. In that embodiment, the structures of the parallelogram are supported with a base assembly.

According to an advantage of the present invention, the deck can rise in a vertical or near vertical manner. This is accomplished in a preferred embodiment by having the parallelograms extend in opposing rotational directions. The first parallelogram can rise in a counterclockwise orientation, and the second parallelogram can rise in a clockwise orientation. The extensions of the parallelograms, respectively, are preferably made at equal speed and with equal lateral travel. The actual rotations of each parallelogram can effectively cancel each other out resulting in generally vertical rise.

According to another advantage of the present invention, the deck can have a relatively fast rate of rising and lowering. This is accomplished in a preferred embodiment by having two actuators acting in series rather than parallel. A further advantage of operating in series is that if one of the actuators fails, the bed will not become unbalanced and the deck will always remain generally parallel with the floor. This reduces the risk or injury if a failure occurs.

According to a further advantage of the present invention, the actuators are operated in an improved efficiency. This is accomplished in a preferred embodiment by having the ends of the actuators move in opposed directions, and not fixed to the deck. This is further accomplished by changing the effective length of one of the arms of the levers. As the parallelograms extend, the respective control arm causes an end of the each actuator to move relative the respective interface to shorten the effective length of the third arm of the respective lever to increase the lift to stroke ratio of the actuators. The result is that the load curve of the actuators can be held relatively steady at or near peak efficiency throughout their entire respective strokes.

According to a further advantage yet of the present invention, the marginal difference in loads between the first and second actuators (due to the increase in weight of the additional components for the second actuator) can be compensated for by the design of the geometry of the interfaces, respectively. Compensating for the weight variance allows the first and second parallelograms to extend at equal rates resulting in vertical rise of the bed.

According to a still further advantage yet of the present invention, the end of the control arm opposite the actuator is connected to the drag link. Advantageously, the control arm may act in compression for at least a majority of the actuator stroke. Further, the portion of the drag link connected to the control arm rotates at an offset radius around a central rotational axis of the lever. In one embodiment, the end of the control arm that is connected to the drag link is allowed to float within the interface when the control arm is not in compression.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
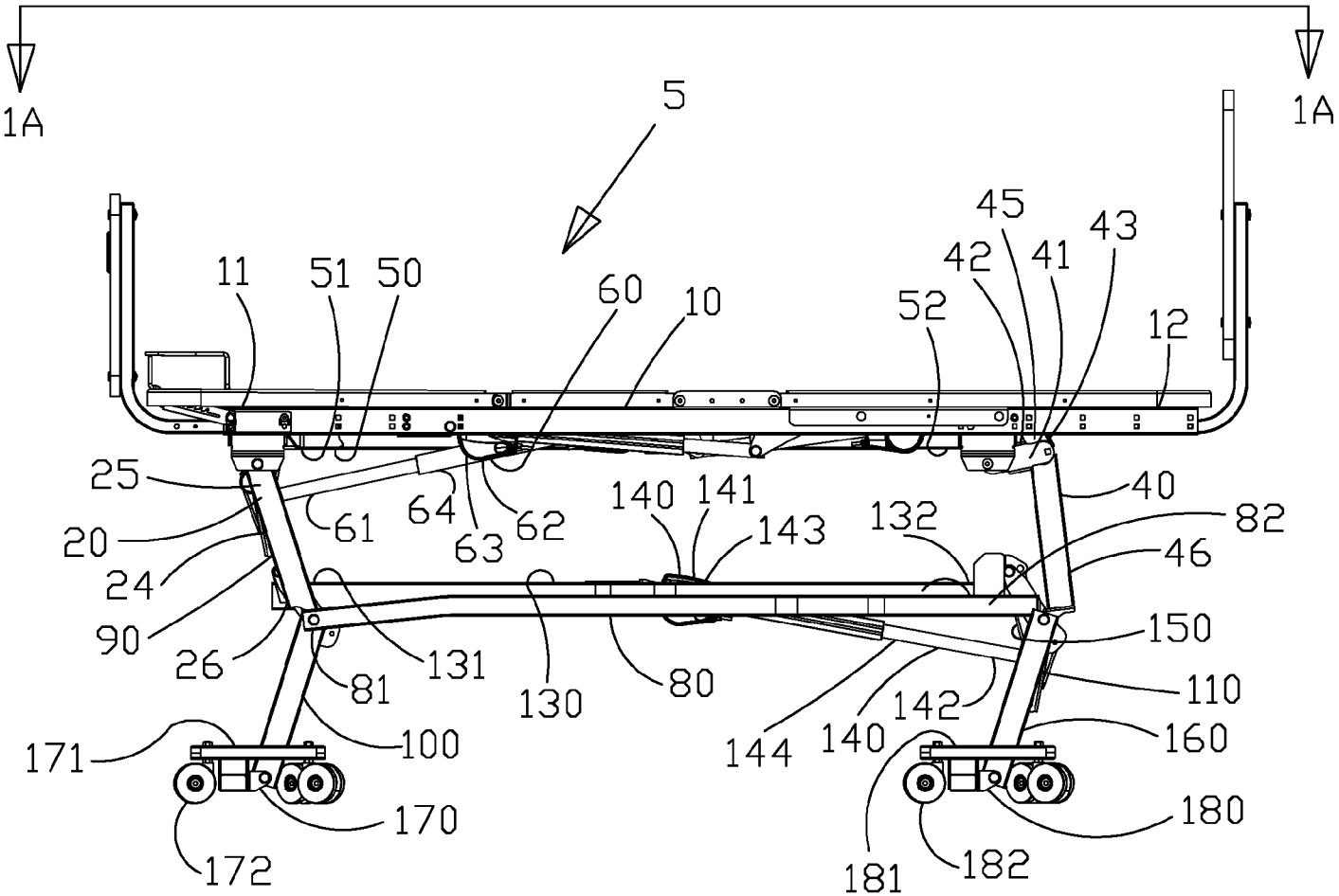
FIG. 1 is a side view of a preferred embodiment of the present invention in a high position.
Figure 1A:
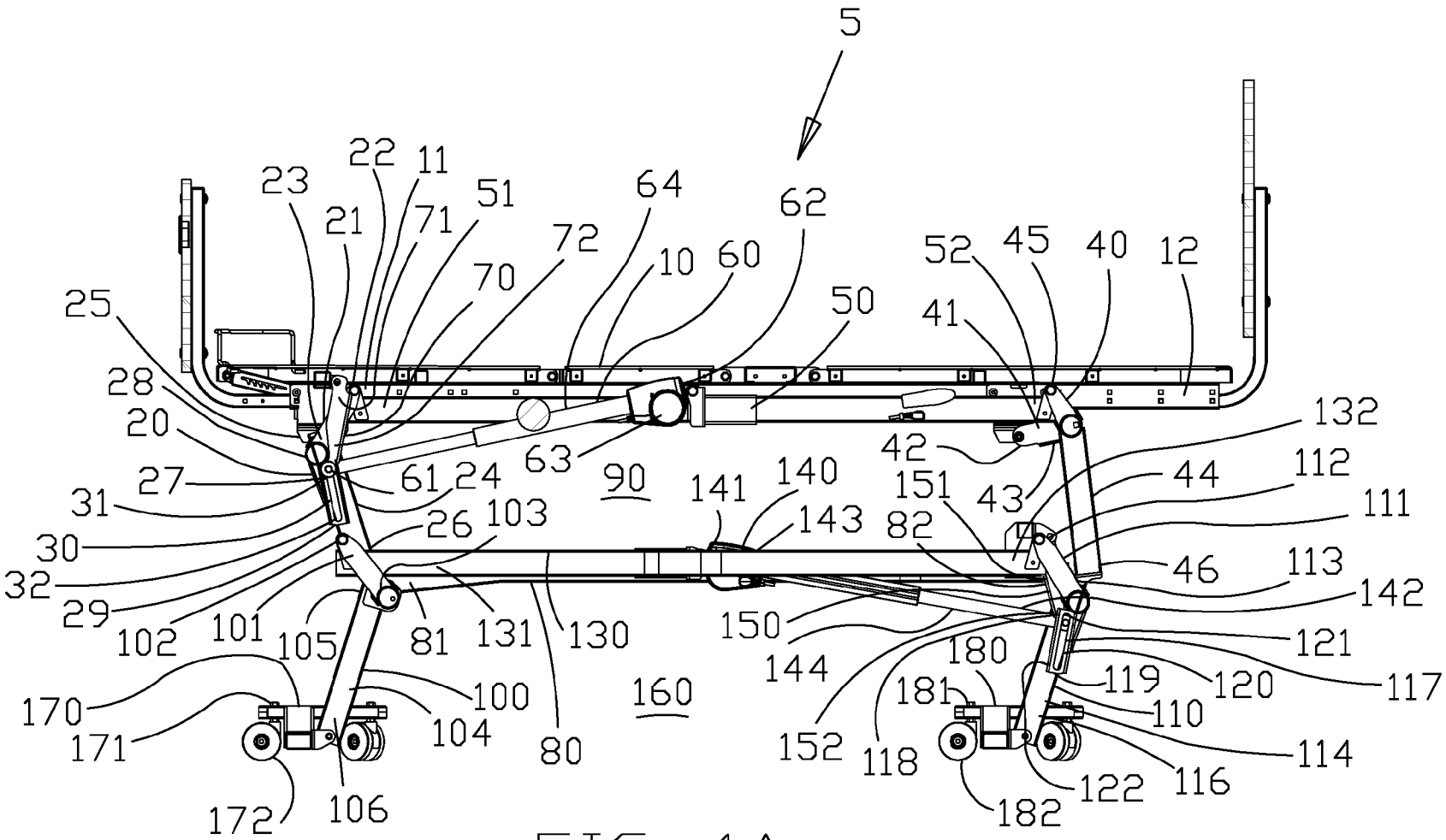
FIG. 1A is a section side view of the preferred embodiment shown in FIG. 1.
Figure 2:
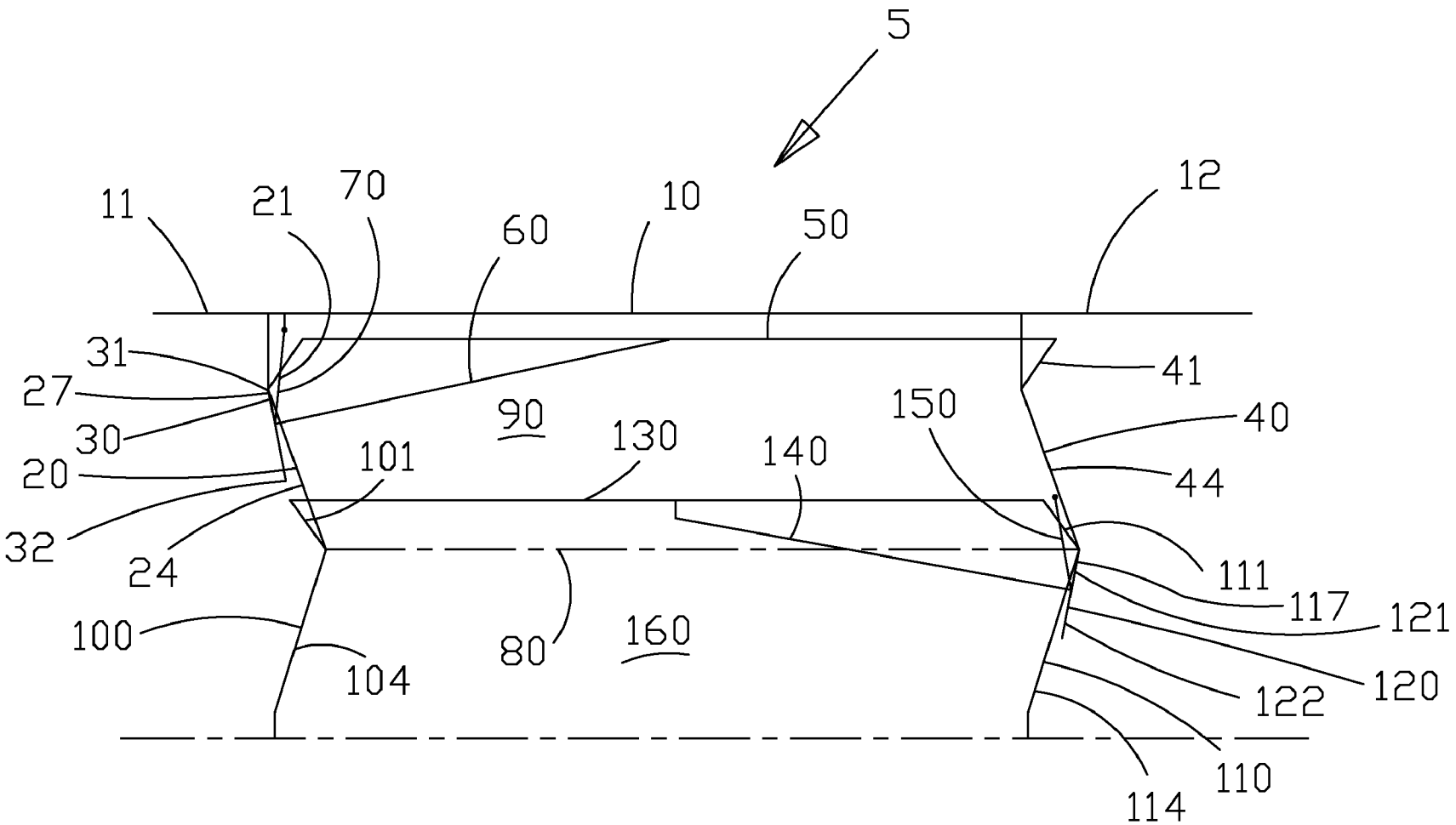
FIG. 2 is a schematic view of a preferred embodiment of the present invention in a high position.
Figure 3:
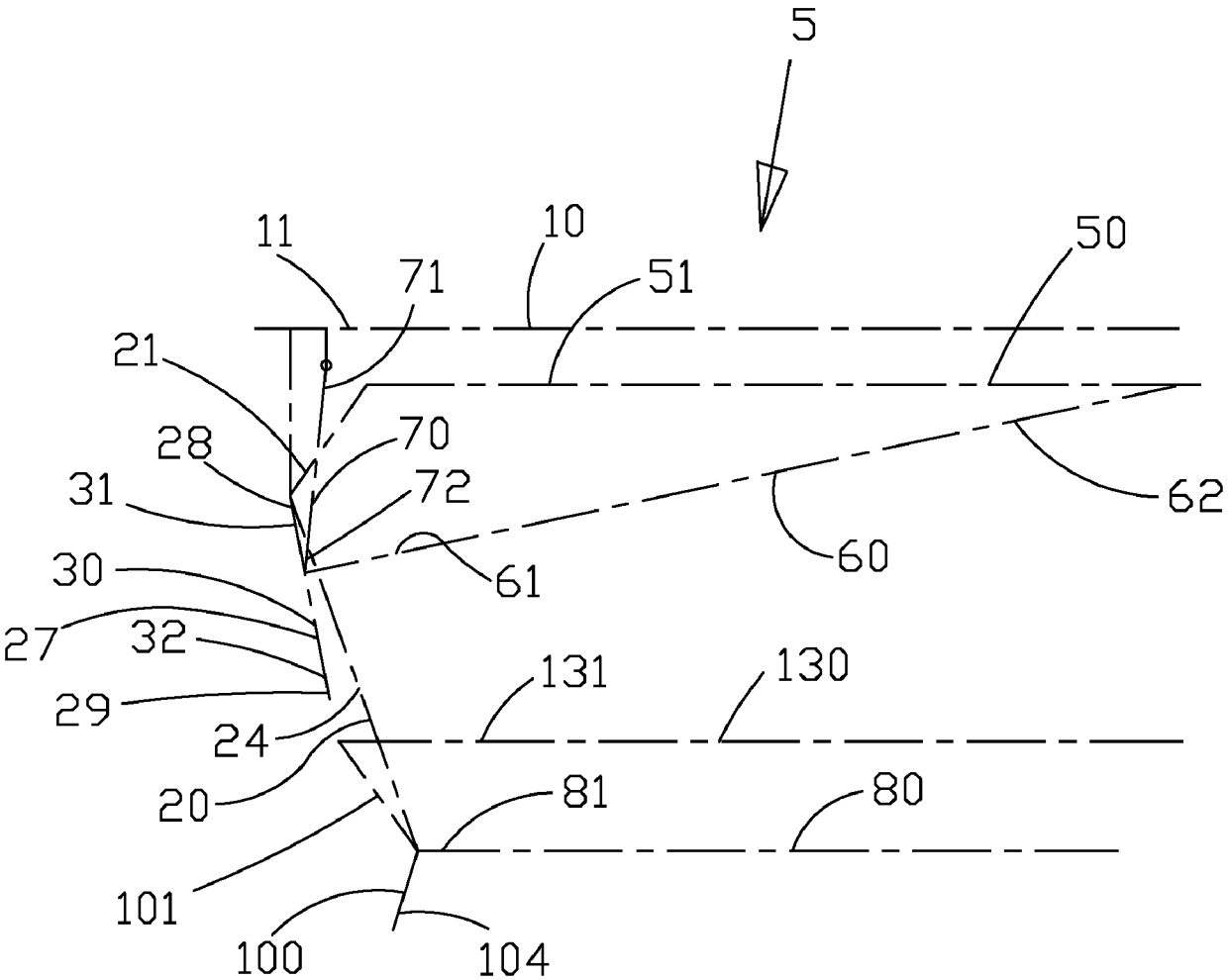
FIG. 3 is a close-up view of a portion of FIG. 2.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

A bed 5 is provided according to one embodiment of the present invention as shown in FIGS. 1-10. The bed 5 has a main-frame and deck, hereafter referred to collectively as a deck 10. The deck 10 has a first end 11 and a second end 12.

A first lever 20 is preferably at the first end 11 of the deck 10. The first lever 20 has arms 21, 24 and 27. The arms 21, 24 and 27 are rigidly connected to a cross-beam. The arms 21, 24 and 27 rotate about a central axis at the same rate. The cross-beam need not be concentric with the central axis. Arm 21 has a first end 22 and a second end 23. Arm 24 has a first end 25 and a second end 26. Arm 27 has a first end 28 and a second end 29. Arm 27 further has an interface or path formed therein. One preferred interface is a track 30 or slide or slot. It is appreciated that other interfaces, such as a cam and follower could be used without departing from the broad aspects of the present invention. Track 30 has a first end 31 and a second end 32. Track 30 can be straight or curved. The first end 25 of arm 24, or deck arm 24, is preferably pivotally connected to the deck 10.

A second lever 40 is preferably at the second end 12 of the deck 10. The second lever 40 has arms 41 and 44. Arms 41 and 44 are rigidly connected to a cross-beam. The arms 41 and 44 rotate about a central axis at the same rate. The cross-beam and central axis need not be concentric. Arm 41 has a first end 42 and a second end 43. Arm 44 has a first end 45 and a second end 46. Arm 44, or deck arm 44, connects to the deck 10.

A drag link 50 is provided for connecting the first lever 20 and the second lever 40. The drag 50 has a first end 51 and an opposed second end 52. The first end 51 of the drag link 50 is pivotally connected to the first end 22 of arm 21, or drag link arm 21. The second end 52 of the drag link 50 is pivotally connected to the first end 42 of arm 41, or drag link arm 41.

Figure 4:
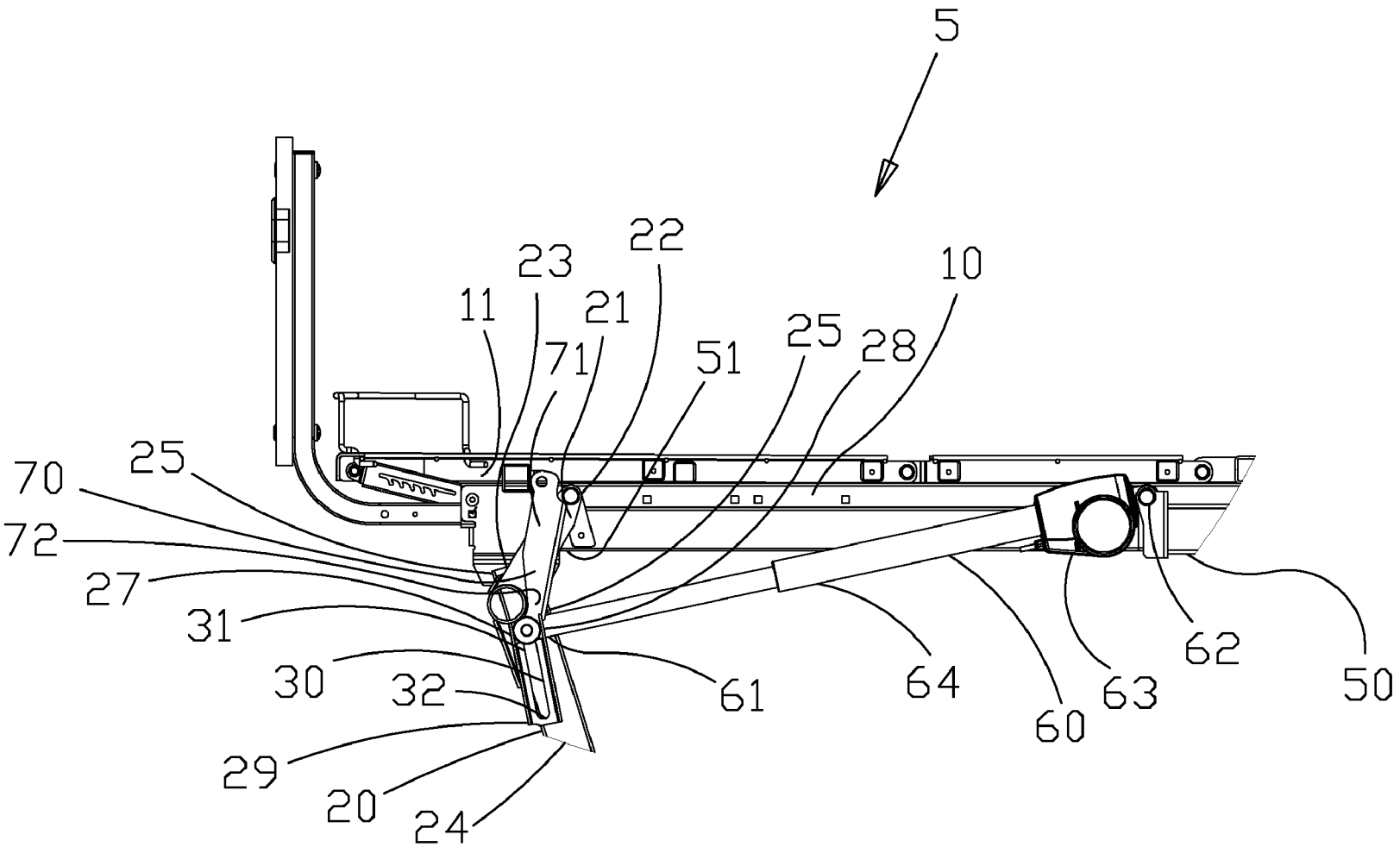
FIG. 4 is a side section view of a portion of the present invention in a high position.
Figure 5:
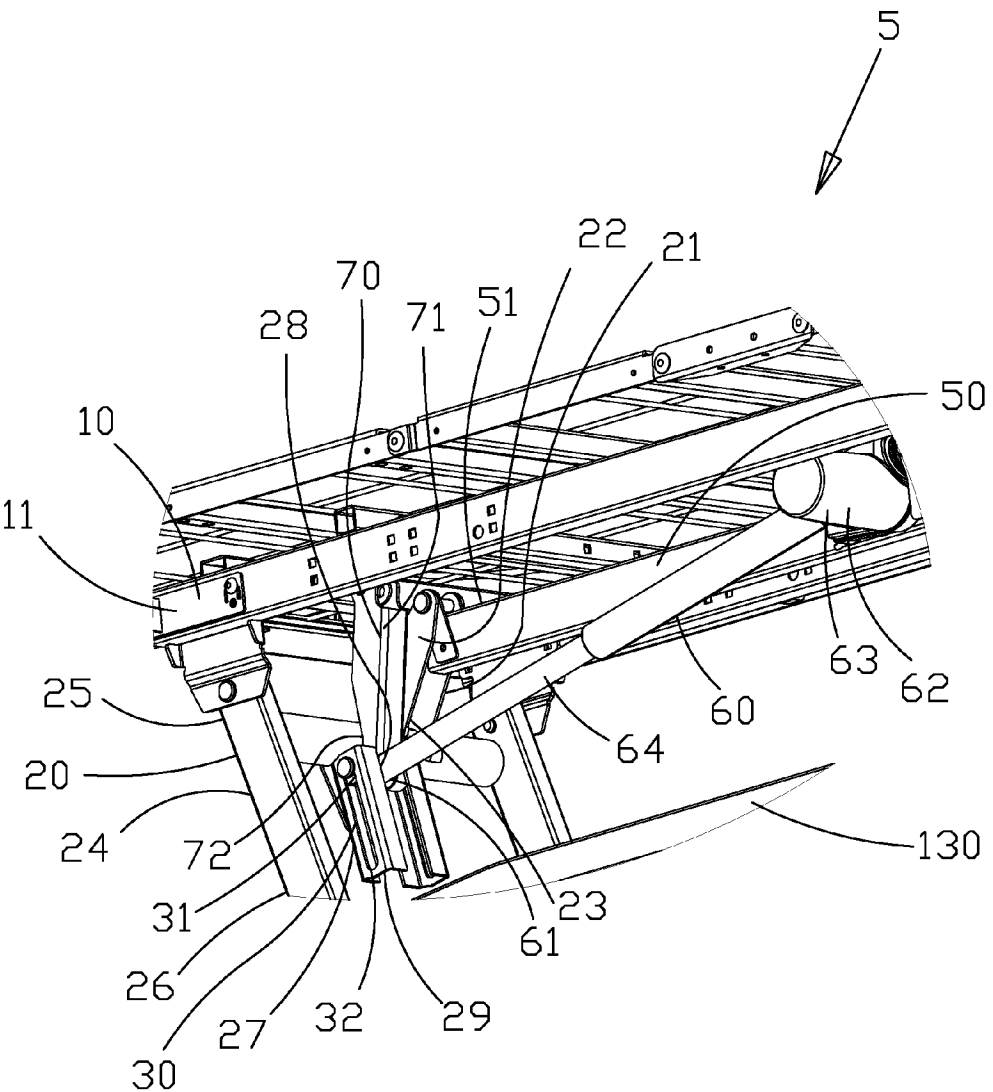
FIG. 5 is a perspective view of the view shown in FIG. 4.

An actuator 60 is further provided. The actuator has a first end 61 and a second end 62. The actuator 60 further has a motor 63 and a linear shaft 64. In the preferred embodiment, the actuator 60 is an electrically powered actuator. The motor 63 is at the second end 62 of the actuator 60, and can be pivotally connected to the drag link 50 at a point intermediate the ends 51 and 52. The first end 61 of the actuator 60 is preferably pivotally connected to arm 27, or interface arm 27, of the lever. Further, the first end 61 of the actuator is slideably or movably received within track 30 between the first end 31 and second end 32. As shown in FIGS. 4 and 5, a roller can be provided for co-acting with the interface. Such is a preferred embodiment. Yet, it is understood that other embodiments can be utilized without departing from the broad aspects of the present invention. It is further understood that while the actuator 60 is shown in one orientation relative the drag link 50 and arm 27, that the opposite orientation (motor 63 near arm 27) could be utilized without departing from the broad aspects of the present invention.

A control arm 70 is provided. The control arm has a first end 71 and a second end 72. The first end 71 is pivotally connected to the deck 10. The second end 72 is pivotally connected to end 61 of the actuator 60. The control arm 70 controls the location of the end 61 of the actuator 60 within the track 30.

A mid-frame 80 is further provided having a first end 81 and a second end 82. The second end 26 of arm 24 is pivotally connected to the first end 81 of the mid-frame 80. The second end 46 of arm 44 is pivotally connected to the second end 82 of the mid-frame 80.

The deck 10, lever 20, lever 40 and mid-frame 80 comprise a first parallelogram 90. The parallelogram is preferably comprised of theoretical lines drawn between connection points of the components, and not necessary comprised of the structure of the components themselves, respectively. The parallelogram 90 expands as the bed rises in a clockwise rotation, and collapses as the bed collapses in a counter-clockwise rotation. The deck 10 and mid-frame 80 remain generally parallel during the expansion and collapse of parallelogram 90.

Figure 9:
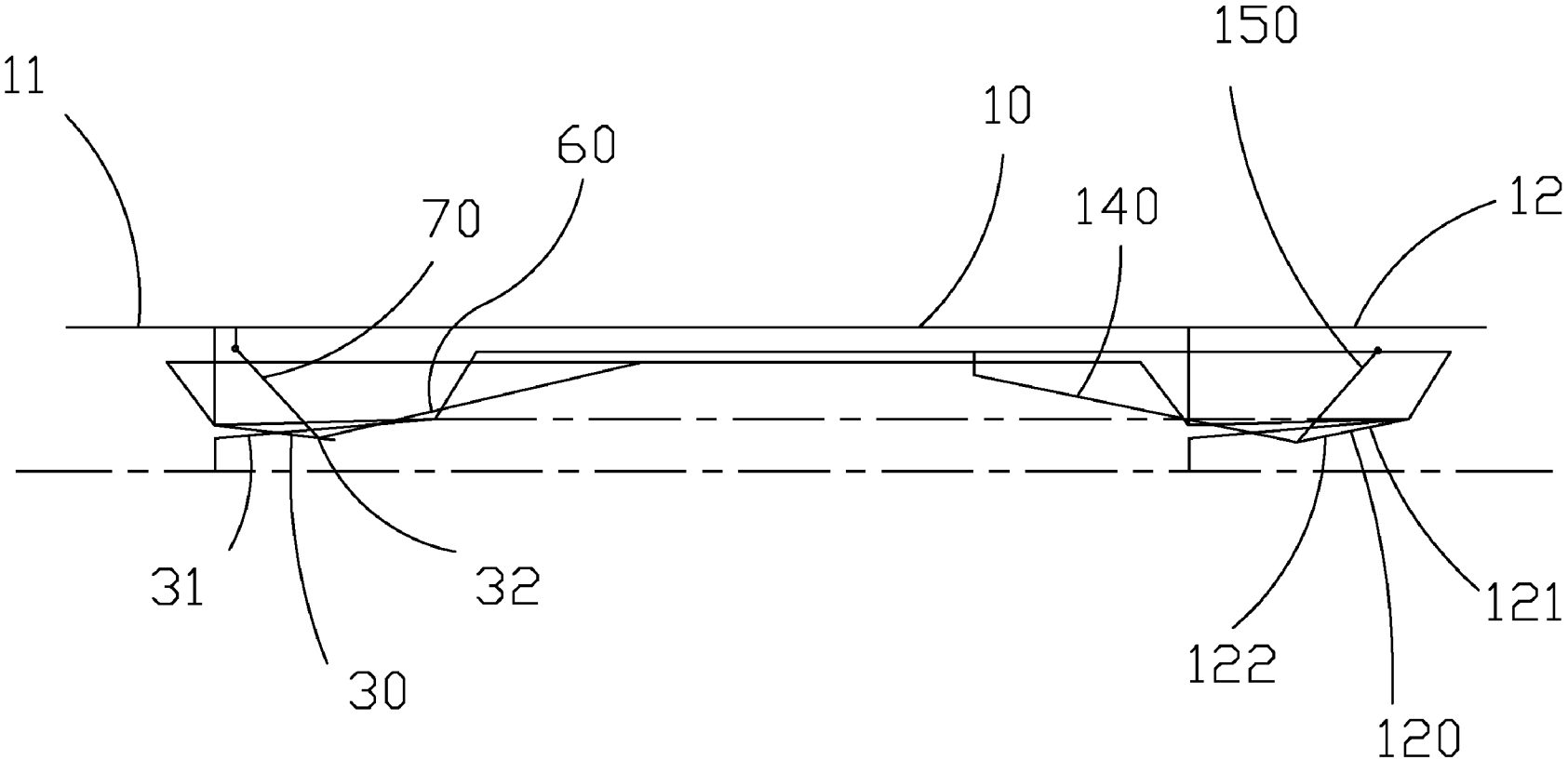
FIG. 9 is a schematic view of the preferred embodiment of the present invention shown in a low position.
Figure 10:
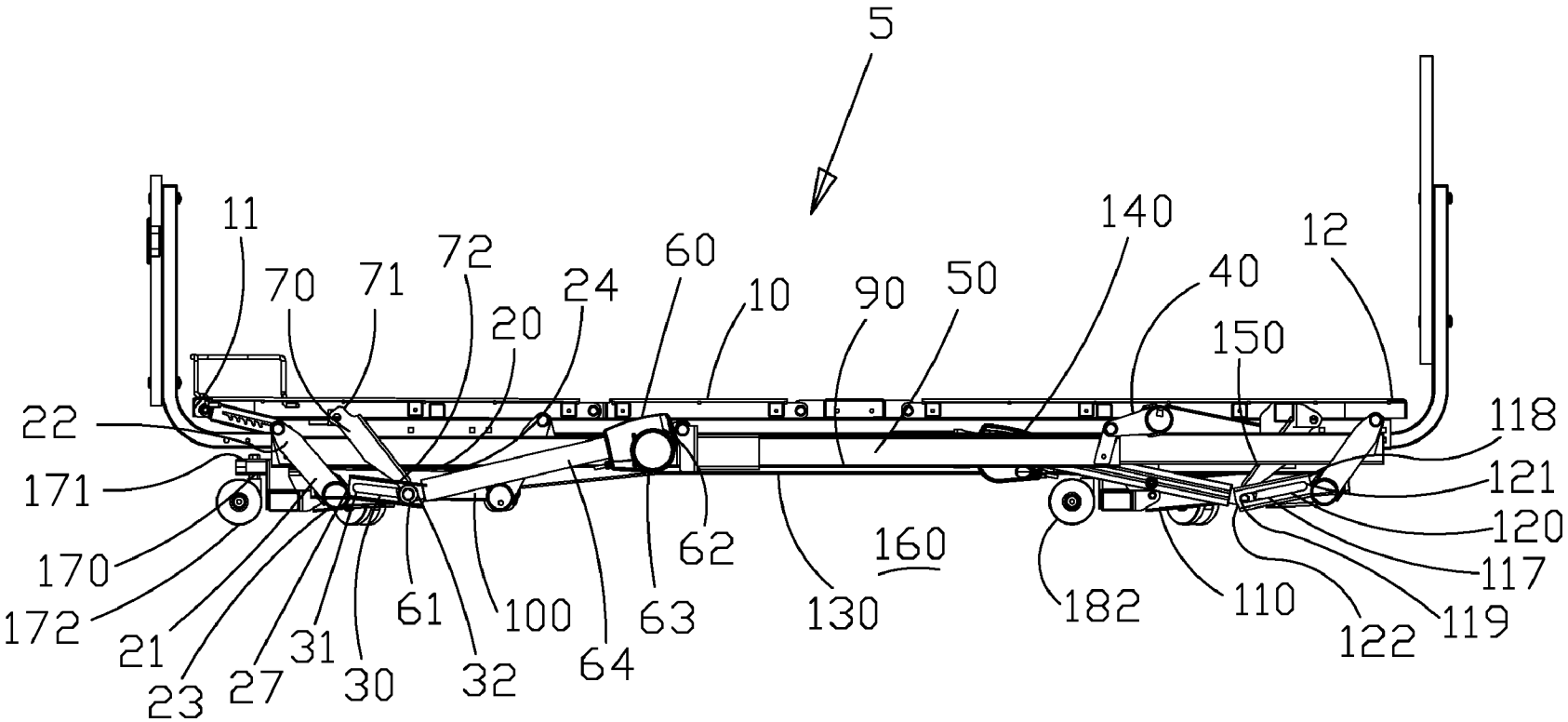
FIG. 10 is a section view of the preferred embodiment of the present invention shown in a low position.
Figure 11:
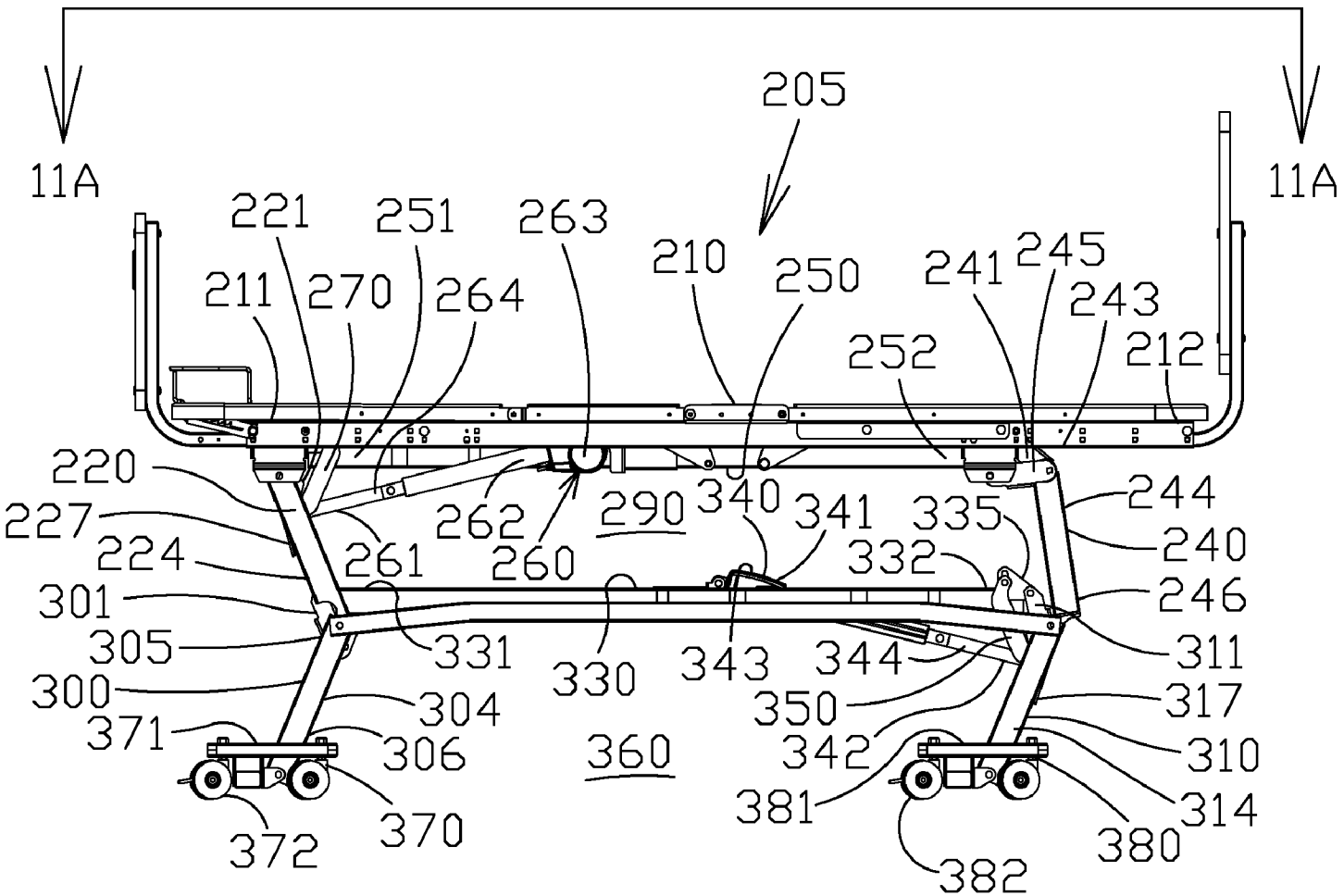
FIG. 11 is a side view of an alternative preferred embodiment of the present invention in a high position.
Figure 11A:
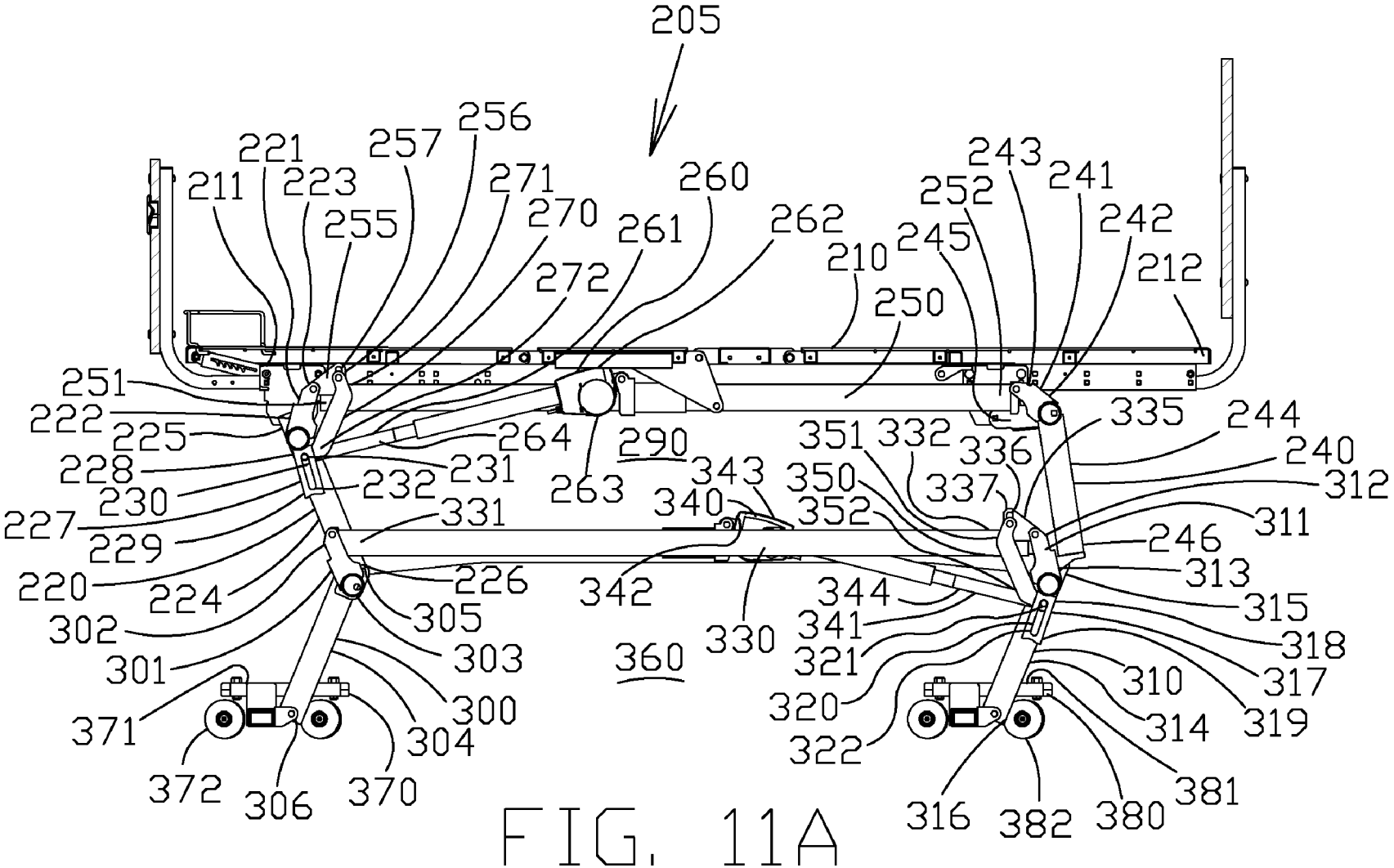
FIG. 11A is a section side view of the embodiment shown in FIG. 11.
Figure 12:
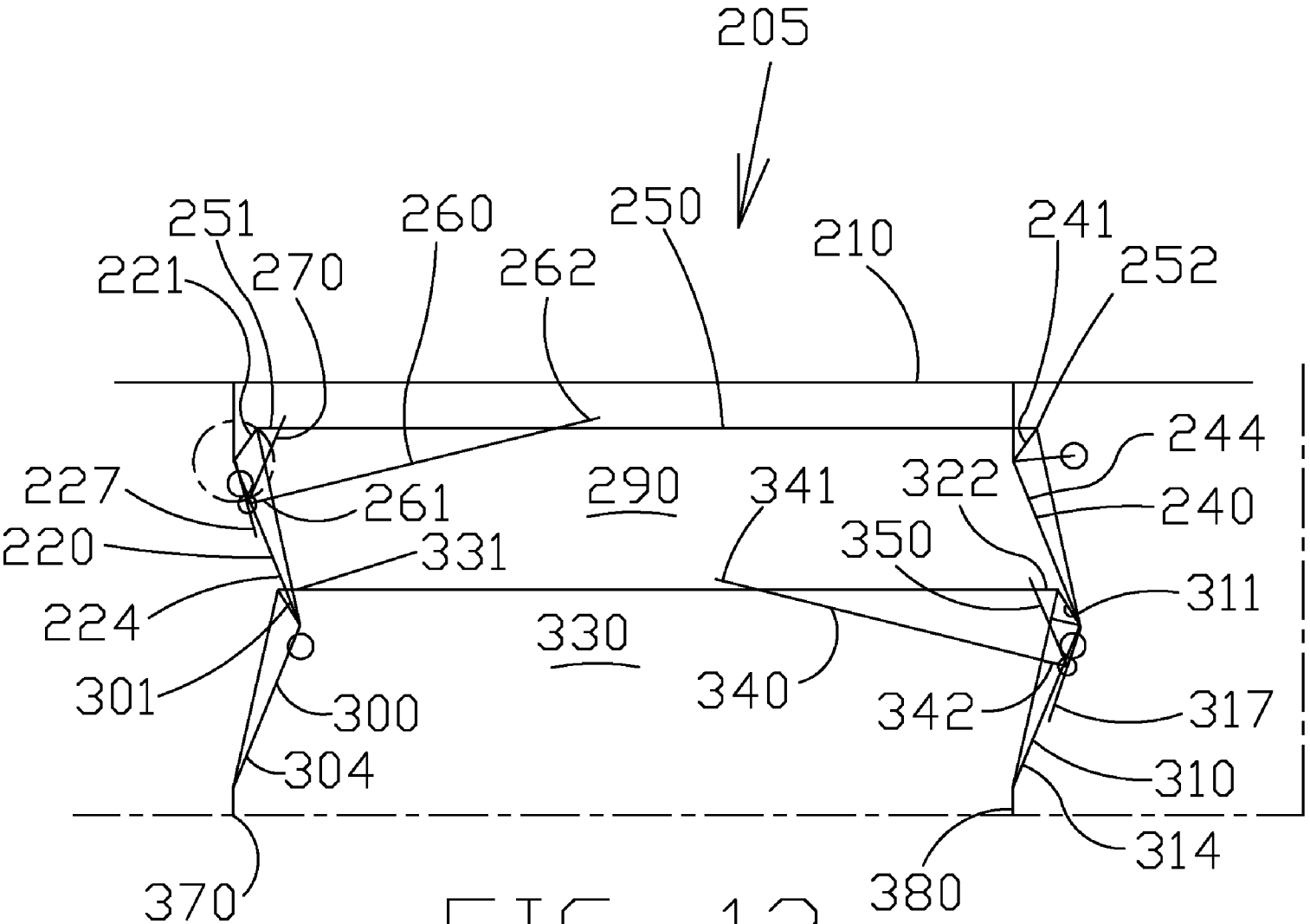
FIG. 12 is a schematic view of the embodiment shown in FIG. 11 in a high position.
Figure 13:
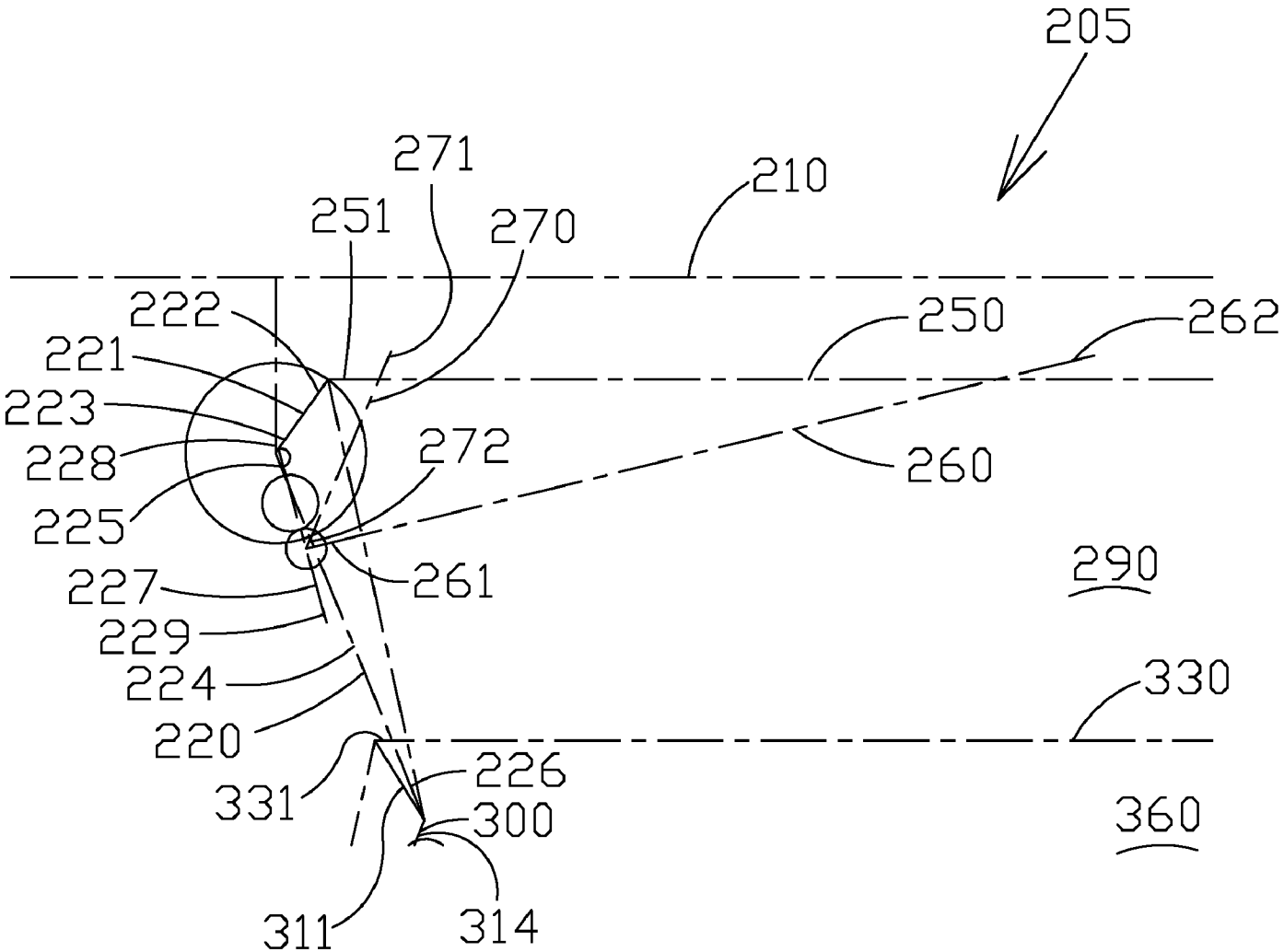
FIG. 13 is a close-up view of a portion of FIG. 12.

When the bed is collapsed, or in the low position, as shown in FIGS. 9 and 10, the control arm 70 dictates that the first end 61 of the actuator 60 be positioned at the second end 32 of the track 30. In this position, the effective length of arm 27 is maximized. The length of the arm 27 determines the ratio of lift in the bed 5 relative stroke of the actuator 60. At the low position, a large amount of force is required to lift the bed 5 a small amount. The large effective length allows for a relatively large amount of torque to be created. A maximum effective length is therefore desirable so that the actuator 60 can act at or near peak efficiency.

Figure 6:
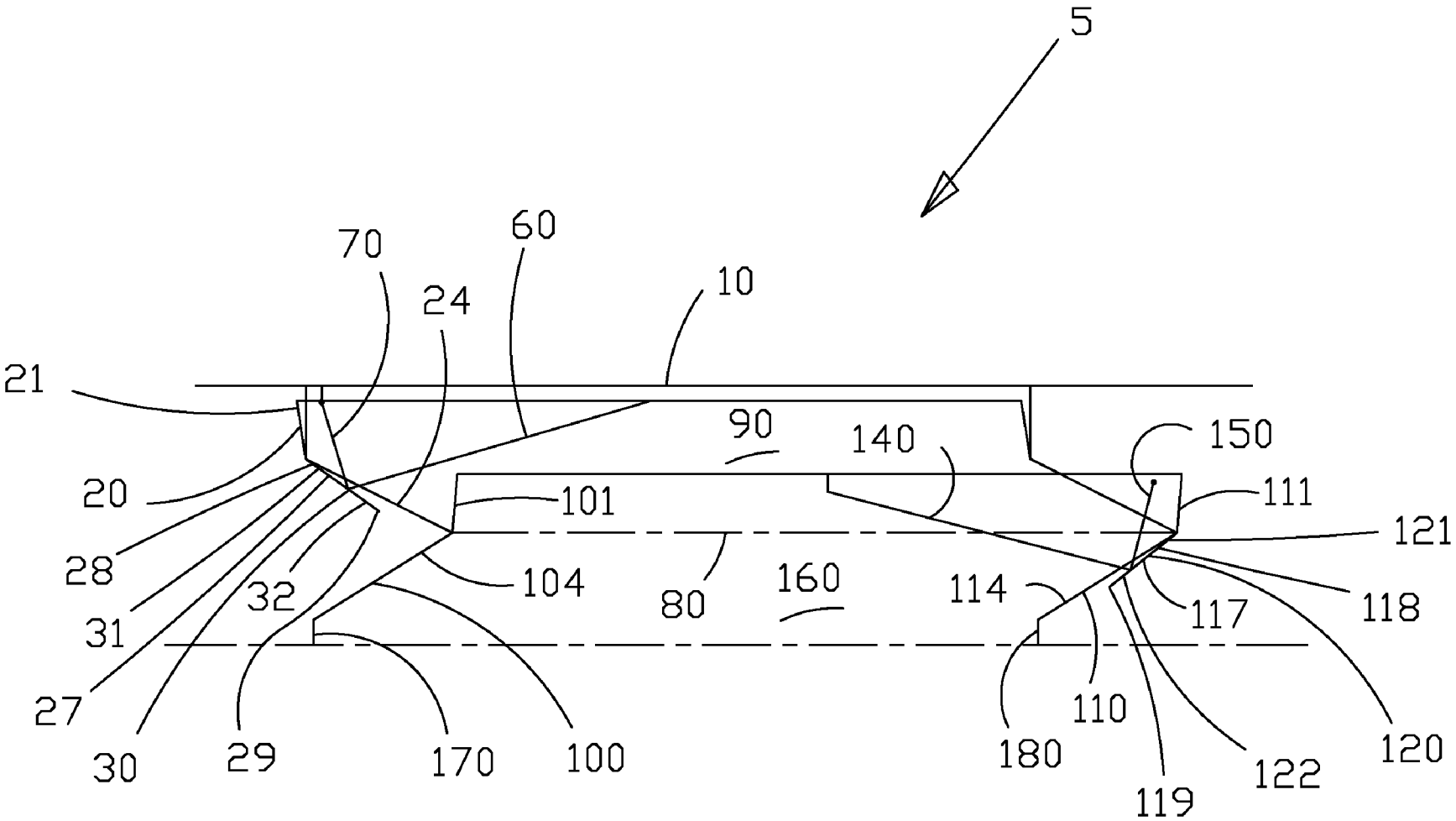
FIG. 6 is a schematic view of the preferred embodiment of the present invention shown in a mid-high position.
Figure 7:
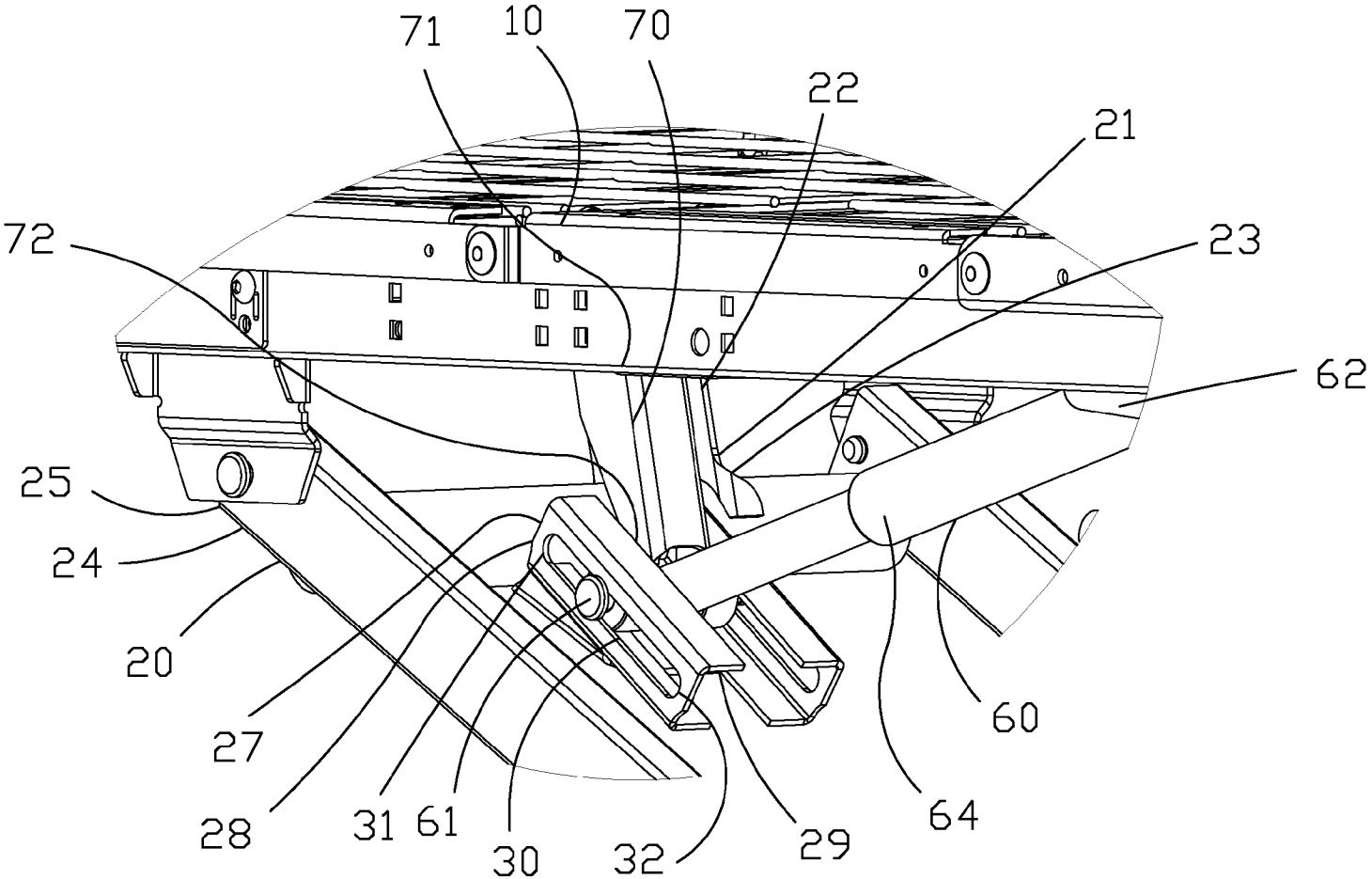
FIG. 7 is a partial perspective view of the preferred embodiment of the present invention shown in a mid-high position.
Figure 8:
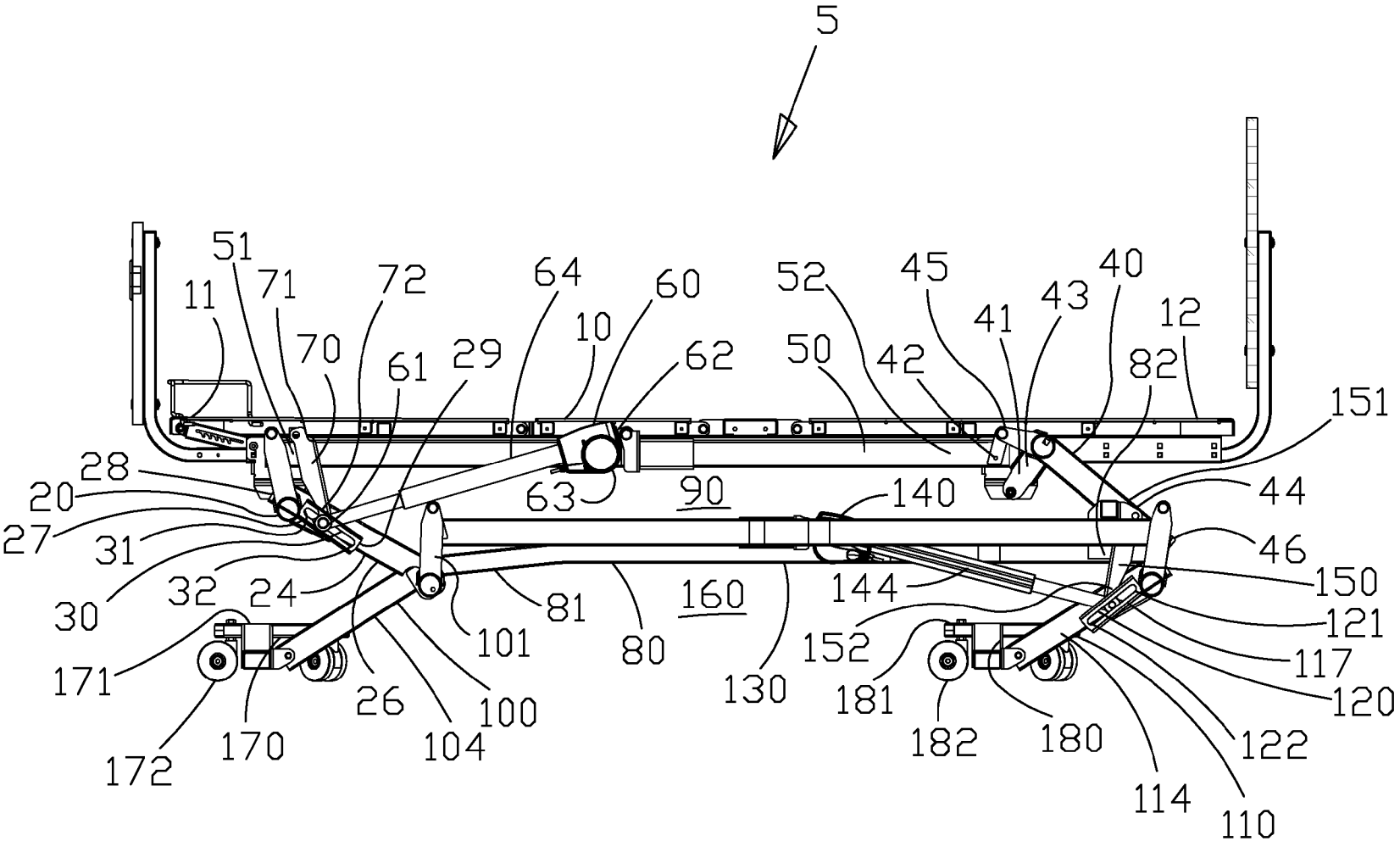
FIG. 8 is a section side view of the preferred embodiment of the present invention shown in a mid-high position.

The bed 5 is shown in a mid position in FIGS. 6-8. While the bed 5 is rising, the first end 61 of the actuator 60 slides in the track 30 away from end 32 and towards end 31. This shortens the effective length of arm 27 to increase the ratio of lift to stroke, and increase the speed of rotation of arms 21, 24 and 27 about the central axis. Increasing the ratio of lift to stroke maintains the output of the actuator near its peak capacity, and hence utilizes the actuator at or near peak efficiency.

The first end 61 of the actuator approaches the first end 31 of the track as the bed 5 reaches the high position (and when the parallelogram 90 is fully extended). The high position of the bed 5 is shown in FIGS. 1-5.

It is appreciated that since the actuator 60 is connected to drag link 50, it is not directly connected to or fixed to the deck 10. Further, since the actuator is connected to arm 27, it is not directly connected to or fixed to the mid-frame 80. Accordingly, the actuator 60 is a floating actuator.

It is also appreciated that the first end 61 of the actuator 60 can preferably continuously slide with track 30 as the bed 5 is being raised or lowered. It is possible, but not required that the first end 61 of the actuator 60 slide within the track 30 at a constant rate.

A third lever 100 is further provided. The third lever 100 has arms 101 and 104. Arms 101 and 104 are rigidly connected to a cross-beam. The arms 101 and 104 rotate about a central axis at the same rate. The cross-beam need not be concentric with the central axis. Arm 101 has a first end 102 and a second end 103. Arm 104 has a first end 105 and a second end 106. Arm 104, or mid-frame arm 104, pivotally connects to the mid-frame 80 near the first end 81.

A fourth lever 110 is preferably at the second end 82 of the mid-frame 80. The fourth lever 110 has arms 111, 114 and 117. The arms 111, 114 and 117 are rigidly connected to a cross-beam. The arms 111, 114 and 117 all rotate about a central axis at the same rate. The cross-beam and central axis need not be concentric. Arm 111 has a first end 112 and a second end 113. Arm 114 has a first end 115 and a second end 116. Arm 117 has a first end 118 and a second end 119. Arm 117 further has an interface or path formed therein. One preferred interface is a track 120, or slide or slot. It is appreciated that other interfaces, such as a cam and follower may be used without departing from the broad aspects of the present invention. Track 120 has a first end 121 and a second end 122. Track 120 can be straight or curved. The first end 115 of arm 114, or mid-frame arm 114, is preferably pivotally connected to the second end 82 of the mid-frame 80.

A drag link 130 is provided for connecting the third lever 100 and the fourth lever 110. The drag 130 has a first end 131 and an opposed second end 132. The first end 131 of the drag link 130 is pivotally connected to the first end 102 of arm 101, or drag link arm 101. The second end 132 of the drag link 130 is pivotally connected to the first end 112 of arm 111, or drag link arm 111.

An actuator 140 is further provided. The actuator has a first end 141 and a second end 142. The actuator 140 further has a motor 143 and a linear shaft 144. In the preferred embodiment, the actuator 140 is an electrically powered actuator. The motor 143 is at the second end 142 of the actuator 140, and can be pivotally connected to the drag link 130 at a point intermediate the ends 131 and 132. The first end 141 of the actuator 140 is preferably pivotally and slideably or movably connected to arm 117, or interface arm 117, of the lever 110. The first end 141 of the actuator 140 is slideably received within track 120 between the first end 121 and second end 122.

A control arm 150 is provided. The control arm has a first end 151 and a second end 152. The first end 151 is pivotally connected to the mid-frame 80. The second end 152 is pivotally connected to end 141 of the actuator 140. The control arm 150 controls the location of the end 141 of the actuator 140 within the track 120.

A first castor base 170 is provided having a deck 171 and castors 172. The first castor base is pivotally connected to the second end 106 of arm 104.

A second castor base 180 is further provided having a deck 181 and castors 182. The second castor base 180 is pivotally connected to the second end 116 of arm 114.

The mid-frame 80, lever 100, lever 110, castor base 170 and castor base 180 comprise a second parallelogram 160. The parallelogram is preferably comprised of theoretical lines drawn between connection points of the components, and not necessary comprised of the structure of the components themselves, respectively. The parallelogram 160 expands as the bed 5 rises in a counter-clockwise rotation, and collapses as the bed collapses in a clockwise rotation. The mid-frame 80 remains generally parallel to the floor during expansion and collapse of the parallelogram 160.

When the bed is collapsed, or in the low position, as shown in FIGS. 9 and 10, the control arm 150 dictates that the first end 141 of the actuator 140 be positioned at the second end 122 of the track 120. In this position, the effective length of arm 117 is maximized. The length of the arm 117 determines the ratio of lift in the bed 5 relative stroke of the actuator 140. At the low position, a large amount of force is required to lift the bed 5 a small amount. The large effective length allows for a large amount of torque to be created. A maximum effective length is therefore desirable so that the actuator 140 operates at or near peak efficiency.

While the bed 5 is rising, the first end 141 of the actuator 140 slides in the track 120 away from end 122 and towards end 121. This shortens the effective length of arm 117 to increase the ratio of lift to stroke, and increase the rotational speed of the arms 111, 114 and 117 about the central axis. Increasing the ratio of lift to stroke maintains force output of the actuator 140 near its peak capacity, and hence utilizes the actuator at or near peak efficiency.

The first end 141 of the actuator approaches the first end 118 of the track as the bed 5 reaches the high position (and when the parallelogram 160 is fully extended).

It is appreciated that since actuator 140 is connected to the drag link 130, it is not directly connected or fixed to the mid-frame 80. Further, since the actuator 140 is connected to arm 117, it is not directly connected or fixed to either castor base 170 or 180. Accordingly, the actuator 140 is a floating actuator. It is further understood that while the actuator 140 is shown in one orientation relative the drag link 130 and arm 117, that the opposite orientation (motor 143 near arm 117) could be utilized without departing from the broad aspects of the present invention.

It is also appreciated that the first end 141 of the actuator 140 can preferably continuously slide with track 120 as the bed 5 is being raised or lowered. It is possible, but not required that the first end 141 of the actuator 140 slide within the track 120 at a constant rate.

The first parallelogram 90 rotates opposite the second parallelogram 160. In this regard, the overall lift of the bed 5 is generally vertical. This is because the actual swing of parallelogram 90 cancels out or opposes the relative swing of parallelogram 160. The opposed swings of the first and second parallelograms 90 and 160, respectively, occur at approximately an equal rate. Accordingly, the deck 10 remains parallel to the mid-frame 80, which remains parallel to the floor at all positions of the bed 5.

It is also noted that actuators 60 and 140 act in series rather than in parallel. Actuator 60 extends parallelogram 90 and actuator 140 extends parallelogram 160.

It is further appreciated that the mid-frame 80 is useful when accompanied by use of interfaces such as tracks. The use of a mid-frame may be unnecessary in embodiments where no interfaces are utilized.

Looking now to an alternative embodiment of the present invention, a bed 205 is provided according to the embodiment of the present invention as shown in FIGS. 11-20. The bed 205 has a main-frame and deck, hereafter referred to collectively as a deck 210. The deck 210 has a first end 211 and a second end 212.

A first lever 220 is preferably at the first end 211 of the deck 210. The first lever 220 has arms 221, 224 and 227. The arms 221, 224 and 227 are rigidly connected to a cross-beam. The arms 221, 224 and 227 rotate about a central rotational axis, or simply central axis, at the same rate. The cross-beam need not be concentric with the central axis. Arm 221 has a first end 222 and a second end 223. Arm 224 has a first end 225 and a second end 226. Arm 227 has a first end 228 and a second end 229. Arm 227 further has an interface or path formed therein. One preferred interface is a track 230 or slide or slot. It is appreciated that other interfaces, such as a cam and follower could be used without departing from the broad aspects of the present invention. Track 230 has a first end 231 and a second end 232. Track 230 can be straight or curved. The first end 225 of arm 224, or deck arm 224, is preferably pivotally connected to the deck 210.

A second lever 240 is preferably at the second end 212 of the deck 210. The second lever 240 has arms 241 and 244. Arms 241 and 244 are rigidly connected to a cross-beam. The arms 241 and 244 rotate about a central axis at the same rate. The cross-beam and central axis need not be concentric. Arm 241 has a first end 242 and a second end 243. Arm 244 has a first end 245 and a second end 246. Arm 244, or deck arm 244, connects to the deck 210.

A drag link 250 is provided for connecting the first lever 220 and the second lever 240. The drag 250 has a first end 251 and an opposed second end 252. The first end 251 of the drag link 250 is pivotally connected to the first end 222 of arm 221, or drag link arm 221. The second end 252 of the drag link 250 is pivotally connected to the first end 242 of arm 241, or drag link arm 241. An ear 255 is preferably at end 251 of the drag link 250. The ear 255 has an interface 256 such as a track, path or slot. The interface 256 has a first end 257 and a second end 258. In a preferred embodiment, the slot is a linear slot. It is appreciated that the ear 255 may lack a slot and the end of the control arm may be pivotally connected to the drag link (not movably as well) without departing from all of the aspects of the present invention. The drag link 250 remains horizontal when levers 220 and 240 rotate about their respective rotational axis. The connection between drag link 250 and arm 221 rotates about the central rotational axis of lever 220 at a fixed distance. The interface, being fixed relative the connection with the arm 221, orbits the lever central axis in an offset circular path.

Figure 14:
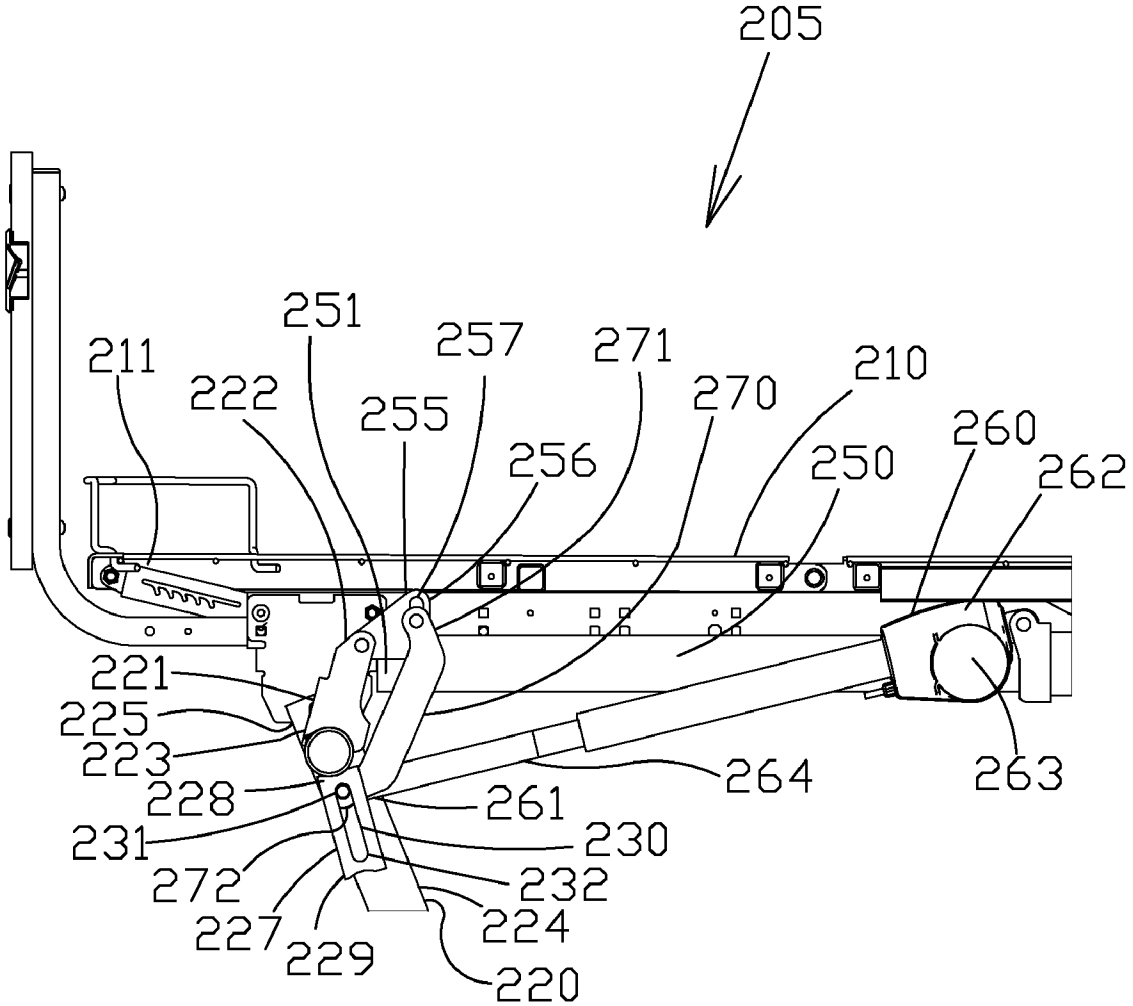
FIG. 14 is a side section view of a portion of the embodiment shown in FIG. 11 in a high position.
Figure 15:
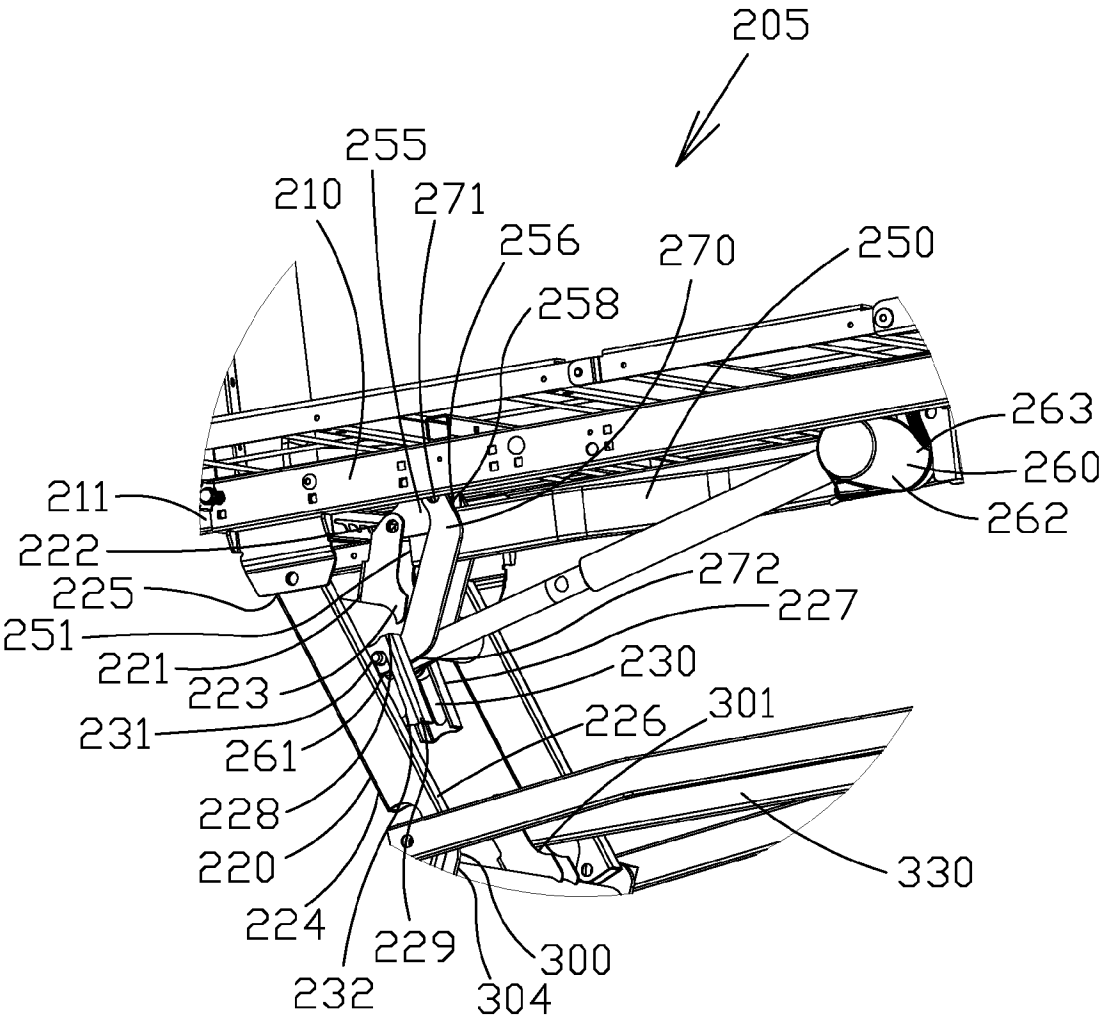
FIG. 15 is a perspective view of the view shown in FIG. 14.

An actuator 260 is further provided. The actuator has a first end 261 and a second end 262. The actuator 260 further has a motor 263 and a linear shaft 264. In the preferred embodiment, the actuator 260 is an electrically powered actuator. The motor 263 is at the second end 262 of the actuator 260, and can be pivotally connected to the drag link 250 at a point intermediate the ends 251 and 252. The first end 261 of the actuator 260 is preferably pivotally connected to arm 227, or interface arm 227, of the lever. Further, the first end 261 of the actuator is slideably or movably received within track 230 between the first end 231 and second end 232. As shown in FIGS. 14 and 15, a roller can be provided for co-acting with the interface. Such is a preferred embodiment. Yet, it is understood that other embodiments can be utilized without departing from the broad aspects of the present invention. It is further understood that while the actuator 260 is shown in one orientation relative the drag link 250 and arm 227, that the opposite orientation (motor 263 near arm 227) could be utilized without departing from the broad aspects of the present invention.

A control arm 270 is provided. The control arm 270 has a first end 271 and a second end 272. The first end 271 is preferably pivotally and movably connected to the interface 256 in the ear 255 on the first end 251 of the drag link 250. The second end 272 is pivotally connected to end 261 of the actuator 260. The control arm 270 controls the location of the end 261 of the actuator 260 within the track 230, as described below.

A first parallelogram 290, or deck parallelogram, is partially defined by levers 220 and 240 and by drag link 250. The parallelogram is preferably comprised of theoretical lines drawn between connection points of the components, and not necessary comprised of the structure of the components themselves, respectively. The parallelogram 290 expands as the bed rises in a clockwise rotation, and collapses as the bed collapses in a counter-clockwise rotation. The deck 210 remains generally parallel to the floor during the expansion and collapse of parallelogram 290.

The second end 226 of arm 224 is preferably pivotally connected to a first end 305 of arm 304, described below. The second end 246 of arm 244 is preferably pivotally connected to a first end 316 of arm 314, described below.

Figure 19:
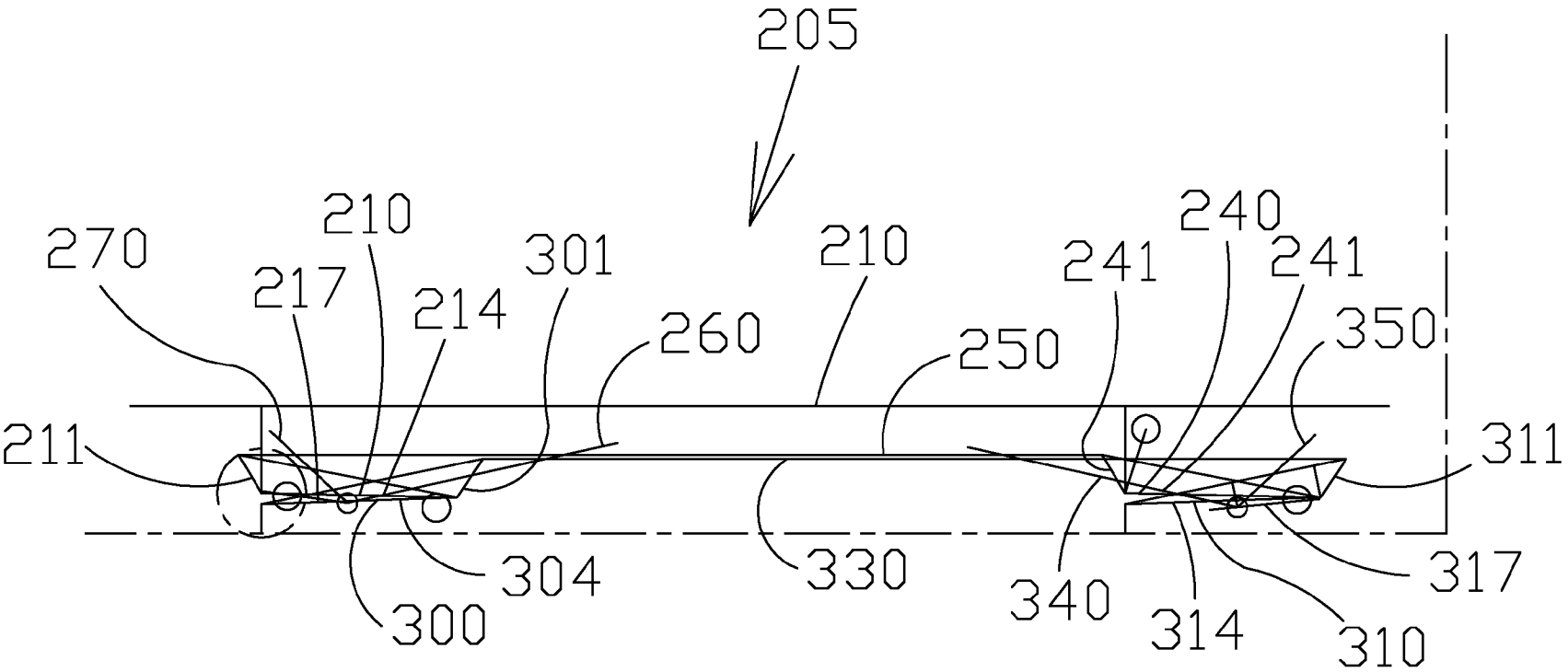
FIG. 19 is a schematic view of the embodiment shown in FIG. 11 shown in a low position.
Figure 20:
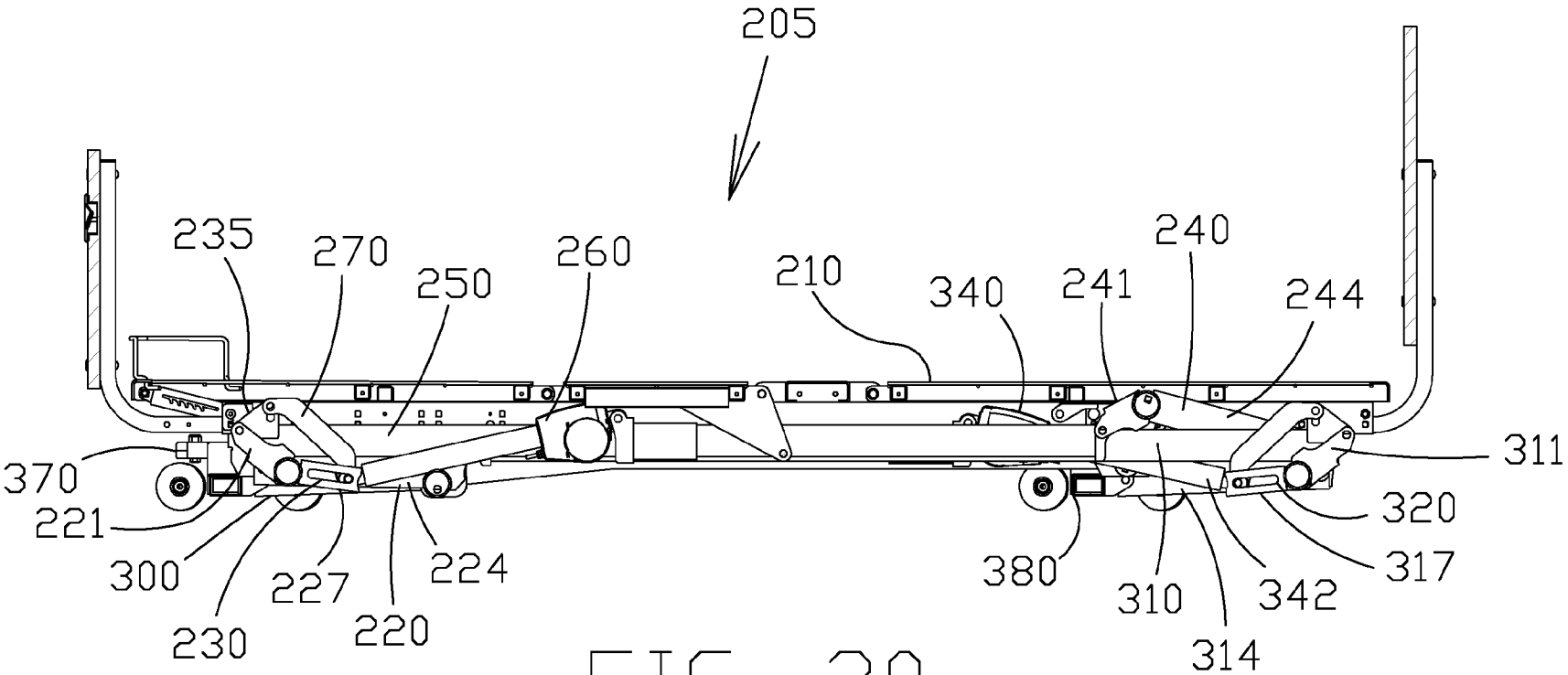
FIG. 20 is a section view of the embodiment shown in FIG. 11 shown in a low position.

When the bed is collapsed, or in the low position, as shown in FIGS. 19 and 20, the control arm 270 dictates that the first end 261 of the actuator 260 be positioned at the second end 232 of the track 230. In this position, the effective length of arm 227 is maximized. The length of the arm 227 determines the ratio of lift in the bed 205 relative stroke of the actuator 260. At the low position, a large amount of force is required to lift the bed 205 a small amount. The large effective length allows for a relatively large amount of torque to be created. A maximum effective length is therefore desirable so that the actuator 260 can act at or near peak efficiency. The first end 271 of the control arm is at the top end 257 of the interface of the ear 255. It is appreciated that the control arm 270 is in compression as the bed 205 starts to rise from the low position and end 271 is bound by end 257 of the interface 256.

Figure 16:
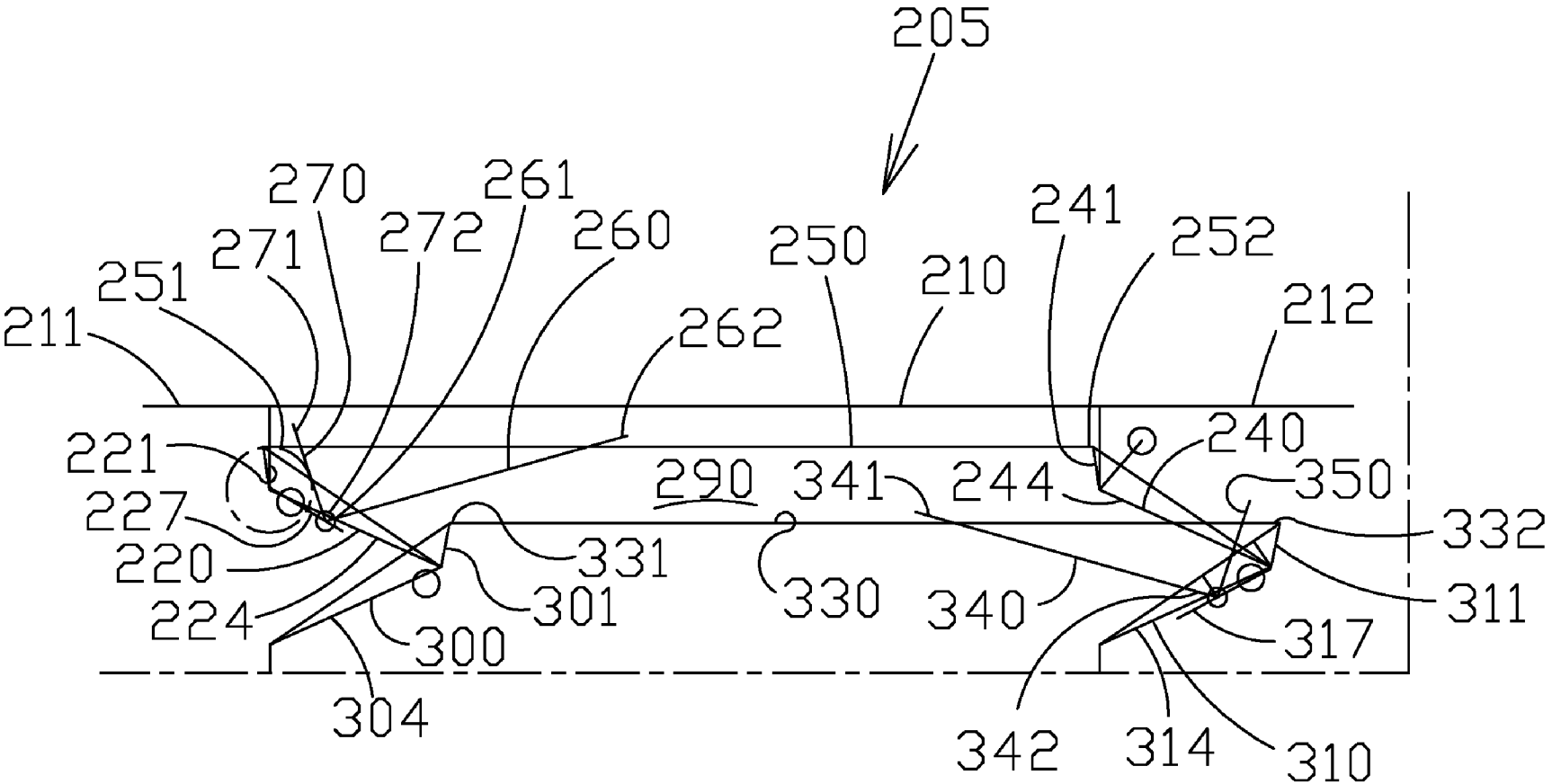
FIG. 16 is a schematic view of the embodiment shown in FIG. 11 shown in a mid-high position.
Figure 17:
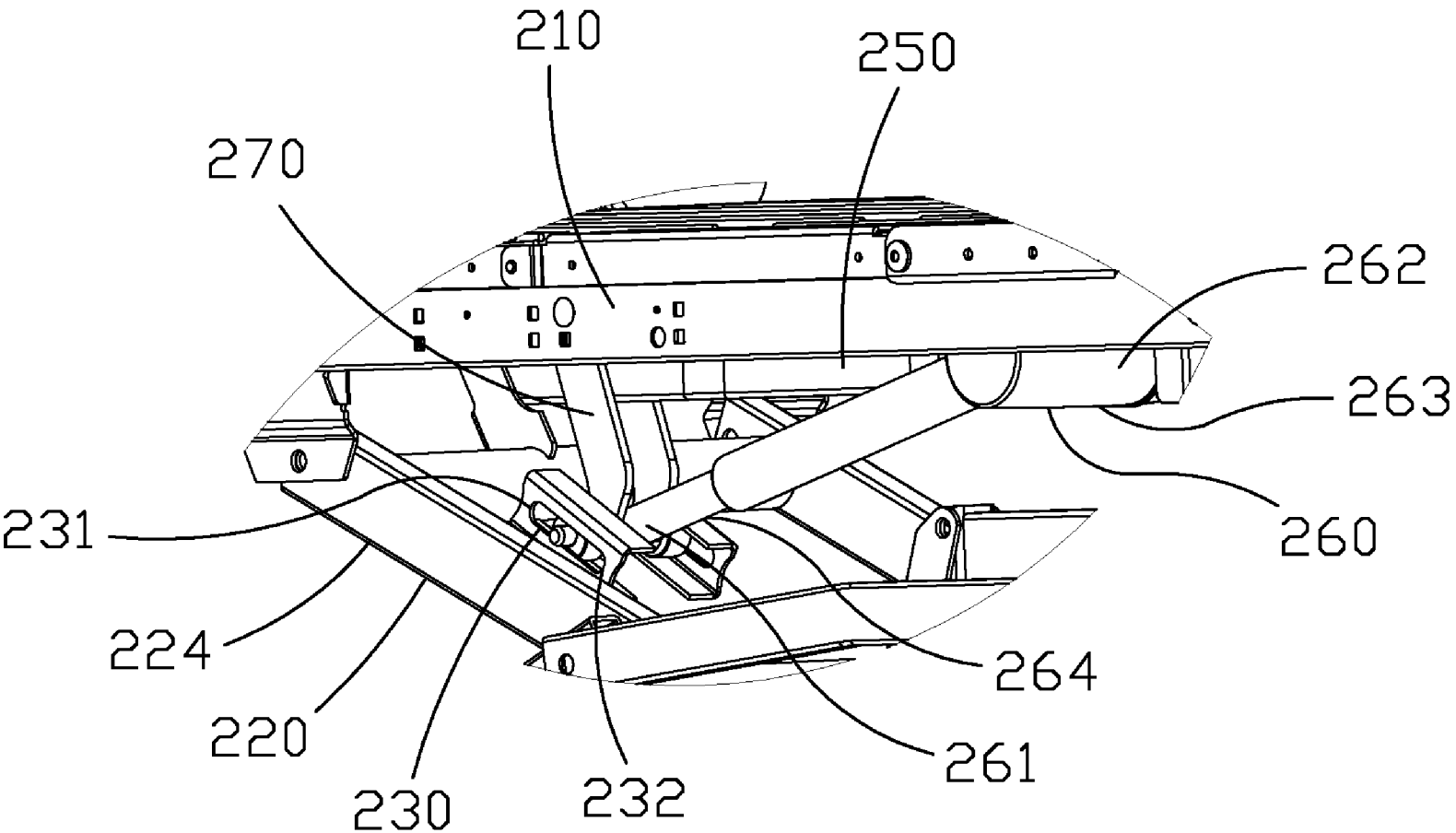
FIG. 17 is a partial perspective view of the embodiment shown in FIG. 11 shown in a mid-high position.
Figure 18:
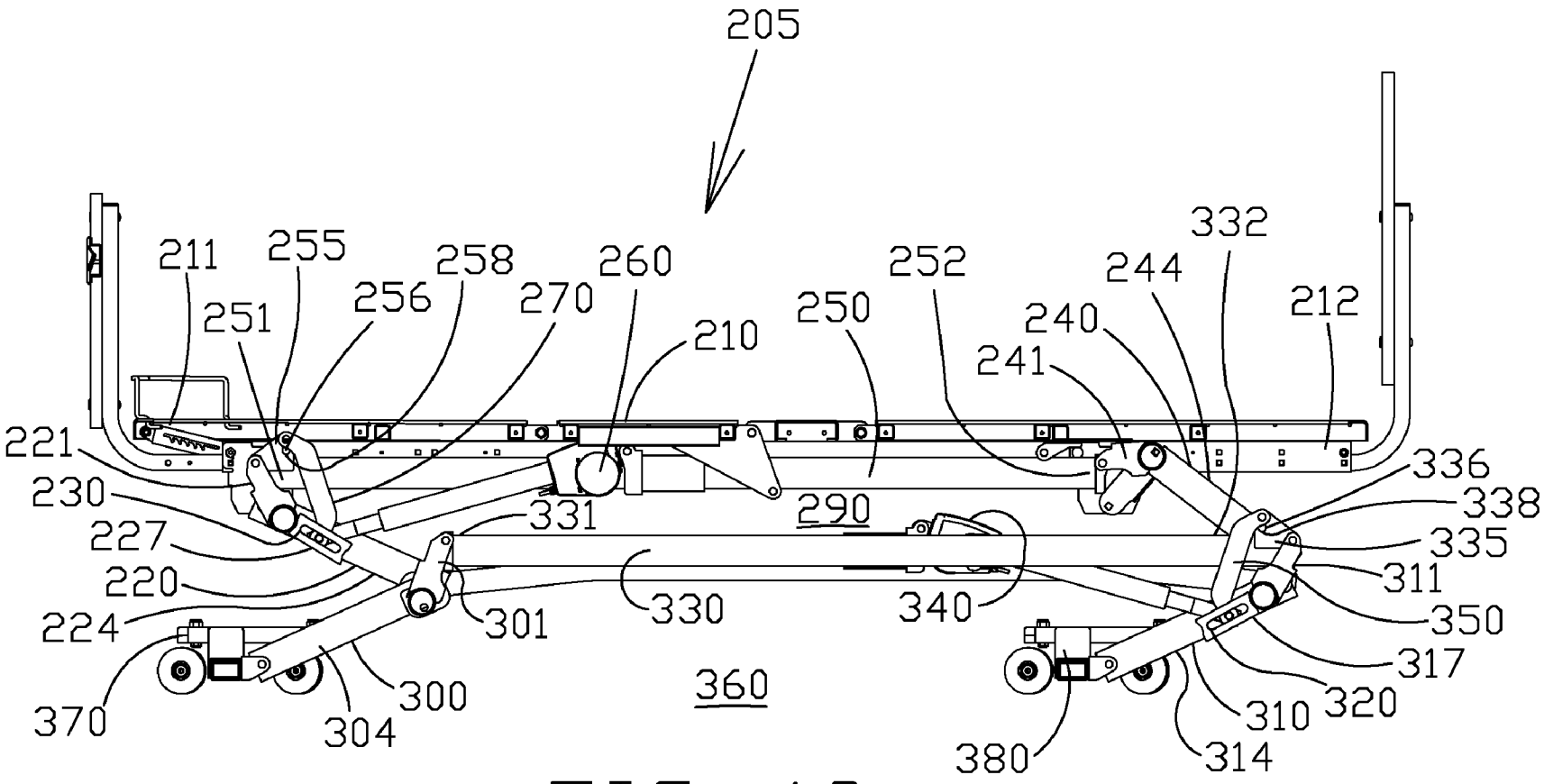
FIG. 18 is a section side view of the embodiment shown in FIG. 11 shown in a mid-high position.

The bed 205 is shown in a mid position in FIGS. 16-18. While the bed 205 is rising, the first end 261 of the actuator 260 slides in the track 230 away from end 232 and towards end 231. This shortens the effective length of arm 227 to increase the ratio of lift to stroke, and increase the speed of rotation of arms 221, 224 and 227 about the central axis. Increasing the ratio of lift to stroke maintains the output of the actuator near its peak capacity, and hence utilizes the actuator at or near peak efficiency. It is appreciated that in this mid position, the control arm 270 is still in compression. While in compression, the end 271 of control arm 270 rotates about the lever central axis in an offset circular path. It is seen that the angle between the centerline of the interface 230 and the actuator 240 is much less than 90 degrees in this mid position.

It is understood that that control arm 270 will remain in compression during a majority of the actuator stroke, and end 271 will be bound by end 257 of interface 256. In one embodiment, end 271 of control arm 270 ceases to engage end 257 of the interface 256 prior to the bed reaching the fully high position. In this embodiment, the control arm 270 enters a no load phase, as end 271 of control arm is neither bound by ends 257 or 258 of slot 256. Further, the angle between the centerline of slot 230 and the actuator preferably does not reach perpendicular before the bed reaches the high position, wherein parallelogram 290 is fully extended.

It is appreciated that since the actuator 260 is connected to drag link 250, it is not directly connected to or fixed to the deck 210. Accordingly, the actuator 260 is a floating actuator.

It is also appreciated that the first end 261 of the actuator 260 can preferably continuously slide with track 230 as the bed 205 is being raised or lowered during the compression stage of the control arm 270. It is possible, but not required that the first end 261 of the actuator 260 slide within the track 230 at a constant rate while the control arm is in compression.

It is still further appreciated that the first end 271 of control arm 270 need not be movable within an interface. The control arm 270, being connected to the drag link, has an end 271 that will rotate at an offset distance about the central axis of lever 220 when in compression. Neither end 271 nor end 272 of the control arm 270 is fixed relative the deck 210 of the bed 205.

A third lever 300 is further provided. The third lever 300 has arms 301 and 304. Arms 301 and 304 are rigidly connected to a cross-beam. The arms 301 and 304 rotate about a central axis at the same rate. The cross-beam need not be concentric with the central axis. Arm 301 has a first end 302 and a second end 303. Arm 304 has a first end 305 and a second end 306. End 226 of arm 224 is preferably pivotally connected to end 305 of arm 304.

A fourth lever 310 has arms 311, 314 and 317. The arms 311, 314 and 317 are rigidly connected to a cross-beam. The arms 311, 314 and 317 all rotate about a central axis at the same rate. The cross-beam and central axis need not be concentric. Arm 311 has a first end 312 and a second end 313. Arm 314 has a first end 315 and a second end 316. Arm 317 has a first end 318 and a second end 319. Arm 317 further has an interface or path formed therein. One preferred interface is a track 320, or slide or slot. It is appreciated that other interfaces, such as a cam and follower may be used without departing from the broad aspects of the present invention. Track 320 has a first end 321 and a second end 322. Track 320 can be straight or curved.

A drag link 330 is provided for connecting the third lever 300 and the fourth lever 310. The drag 330 has a first end 331 and an opposed second end 332. The first end 331 of the drag link 330 is pivotally connected to the first end 302 of arm 301, or drag link arm 301. The second end 332 of the drag link 330 is pivotally connected to the first end 312 of arm 311, or drag link arm 311. An ear 335 is preferably at end 332 of the drag link 330. The ear 335 has an interface 336 such as a track, path or slot. The interface 336 has a first end 337 and a second end 338. In a preferred embodiment, the slot is a linear slot. The drag link 330 remains horizontal when levers 300 and 310 rotate about their respective rotational axis. The connection between drag link 330 and arm 301 rotates about the central rotational axis of lever 300 at a fixed distance. The interface, being fixed relative the connection with the arm 301, orbits the lever central axis in an offset circular path.

An actuator 340 is further provided. The actuator has a first end 341 and a second end 342. The actuator 340 further has a motor 343 and a linear shaft 344. In the preferred embodiment, the actuator 340 is an electrically powered actuator. The motor 343 is at the second end 342 of the actuator 340, and can be pivotally connected to the drag link 330 at a point intermediate the ends 331 and 332. The first end 341 of the actuator 340 is preferably pivotally and slideably or movably connected to arm 317, or interface arm 317, of the lever 310. The first end 341 of the actuator 340 is slideably received within track 320 between the first end 321 and second end 322.

A control arm 350 is provided. The control arm has a first end 351 and a second end 352. The first end 351 is preferably pivotally and movably connected to the interface 336 in the ear 335 on the second end 332 of the drag link 330. The second end 352 is pivotally connected to end 341 of the actuator 340. The control arm 350 controls the location of the end 341 of the actuator 340 within the track 320.

A first castor base 370 is provided having a deck 371 and castors 372. The first castor base is pivotally connected to the second end 306 of arm 304.

A second castor base 380 is further provided having a deck 381 and castors 382. The second castor base 380 is pivotally connected to the second end 316 of arm 314.

A second parallelogram 360, or base parallelogram, is partially defined by levers 300 and 310, and by drag link 330. The parallelogram is preferably comprised of theoretical lines drawn between connection points of the components, and not necessary comprised of the structure of the components themselves, respectively. The parallelogram 360 expands as the bed 205 rises in a counter-clockwise rotation, and collapses as the bed collapses in a clockwise rotation. The deck 210 remains generally parallel to the floor during expansion and collapse of the parallelogram 360. It is appreciated that given the opposed expanding and collapsing of the parallelograms 290 and 360, respectively, the bed 205 rises and collapses in a vertical or near vertical manner.

When the bed is collapsed, or in the low position, as shown in FIGS. 19 and 20, the control arm 350 dictates that the first end 341 of the actuator 340 be positioned at the second end 322 of the track 320. In this position, the effective length of arm 317 is maximized. The length of the arm 317 determines the ratio of lift in the bed 205 relative stroke of the actuator 340. At the low position, a large amount of force is required to lift the bed 205 a small amount. The large effective length allows for a large amount of torque to be created. A maximum effective length is therefore desirable so that the actuator 340 operates at or near peak efficiency. The first end 351 of the control arm is at the top end 337 of the interface of the ear 335. It is appreciated that the control arm 350 is in compression as the bed 205 starts to rise from the low position, as end 351 is bound by end 337 of interface 336.

While the bed 205 is rising, the first end 341 of the actuator 340 slides in the track 320 away from end 322 and towards end 321. This shortens the effective length of arm 317 to increase the ratio of lift to stroke, and increase the rotational speed of the arms 311, 314 and 317 about the central axis. Increasing the ratio of lift to stroke maintains force output of the actuator 340 near its peak capacity, and hence utilizes the actuator at or near peak efficiency. It is appreciated that in this mid position, the control arm 350 is still in compression. While in compression, the end 351 of the control arm 350 rotates about the lever central axis in an offset circular path. The angle between the centerline of interface 320 and actuator 240 is much less than perpendicular at this position.

It is understood that that control arm 350 will remain in compression during a majority of the actuator stroke, and end 351 will be bound by end 337 of interface 336. In one embodiment, end 351 of control arm 350 ceases to engage end 337 of the interface 336 prior to the bed reaching the fully high position. In this embodiment, the control arm 350 enters a no load phase, as end 351 of control arm is neither bound by ends 337 or 338 of slot 336. Further, the angle between the centerline of slot 320 and the actuator preferably does not reach perpendicular before the bed reaches the high position, wherein parallelogram 360 is fully extended.

It is appreciated that since the actuator 340 is connected to drag link 330, it is a floating actuator. It is further understood that while the actuator 340 is shown in one orientation relative the drag link 330 and arm 317, that the opposite orientation (motor 343 near arm 317) could be utilized without departing from the broad aspects of the present invention.

It is also appreciated that the first end 341 of the actuator 340 can preferably continuously slide with track 320 as the bed 205 is being raised or lowered during the compression stage of control arm 350. It is possible, but not required that the first end 341 of the actuator 340 slide within the track 320 at a constant rate while the control arm 250 is in compression.

It is still further appreciated that the first end 351 of control arm 350 need not be movable within an interface. The control arm 350, being connected to the drag link, has an end 351 that will rotate in an offset circular path about the central axis of lever 320 while arm 350 is in compression. Neither end 351 nor end 352 of the control arm 350 is fixed relative the deck 210 of the bed 205.

The first parallelogram 290 rotates opposite the second parallelogram 360. In this regard, the overall lift of the bed 205 is generally vertical. This is because the actual swing of parallelogram 290 cancels out or opposes the relative swing of parallelogram 360. The opposed swings of the first and second parallelograms 290 and 360, respectively, occur at approximately an equal rate. Accordingly, the deck 210 remains parallel to the floor at all positions of the bed 205.

It is also noted that actuators 260 and 340 act in series rather than in parallel. Actuator 260 extends parallelogram 290 and actuator 340 extends parallelogram 360.

Figure 21:
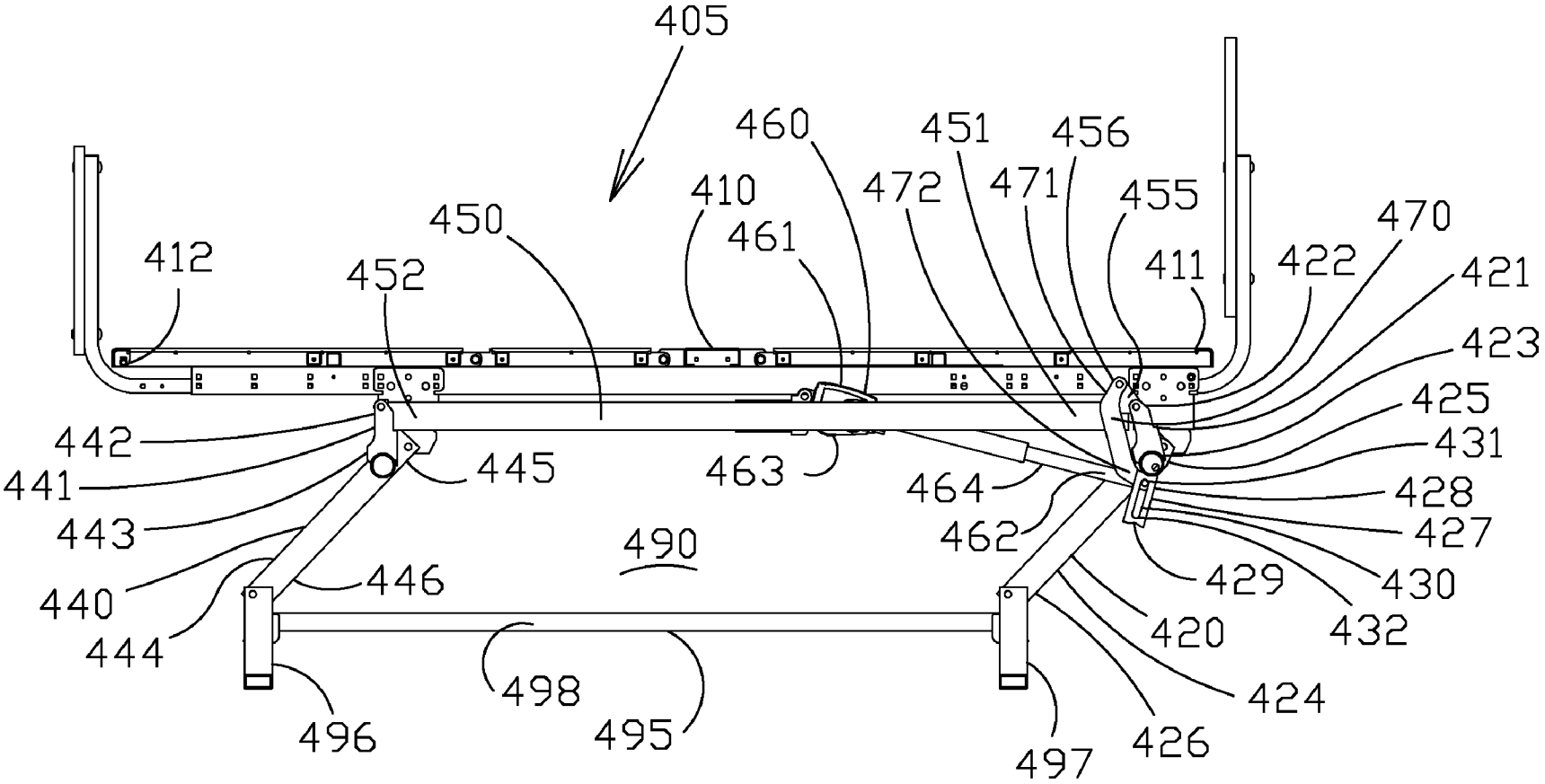
FIG. 21 is a side view of an alternative embodiment of the present invention showing first and second levers being connected to a base assembly.

Looking now to FIG. 21, it is seen that a further alternative embodiment is illustrated. The bed 405 has a main-frame and deck, hereafter referred to collectively as a deck 410. The deck 410 has a first end 411 and a second end 412.

A first lever 420 is preferably at the first end 411 of the deck 410. The first lever 420 has arms 421,422 and 427. The arms 421, 424 and 427 are rigidly connected to a cross-beam. The arms 421, 424 and 427 rotate about a central rotational axis, or simply central axis, at the same rate. The cross-beam need not be concentric with the central axis. Arm 421 has a first end 422 and a second end 423. Arm 424 has a first end 425 and a second end 426. Arm 427 has a first end 428 and a second end 429. Arm 427 further has an interface or path formed therein. One preferred interface is a track 430 or slide or slot. It is appreciated that other interfaces, such as a cam and follower could be used without departing from the broad aspects of the present invention. Track 430 has a first end 431 and a second end 432. Track 430 can be straight or curved. The first end 425 of arm 424, or deck arm 424, is preferably pivotally connected to the deck 410.

A second lever 440 is preferably at the second end 412 of the deck 410. The second lever 440 has arms 441 and 444. Arms 441 and 444 are rigidly connected to a cross-beam. The arms 441 and 444 rotate about a central axis at the same rate. The cross-beam and central axis need not be concentric. Arm 441 has a first end 442 and a second end 443. Arm 444 has a first end 445 and a second end 446. Arm 444, or deck arm 444, connects to the deck 410.

A drag link 450 is provided for connecting the first lever 420 and the second lever 440. The drag 450 has a first end 451 and an opposed second end 452. The first end 451 of the drag link 450 is pivotally connected to the first end 422 of arm 421, or drag link arm 421. The second end 452 of the drag link 450 is pivotally connected to the first end 442 of arm 441, or drag link arm 421. An ear 455 is preferably at end 451 of the drag link 450. The ear 455 has an interface 456 such as a track, path or slot. It is understood that the interface 456 may be a pivotal connector for pivotally connecting to the drag link (not movably as well). The drag link 450 remains horizontal when levers 420 and 440 rotate about their respective rotational axis. The connection between drag link 450 and arm 421 rotates about the central rotational axis of lever 420 at a fixed distance. The interface, being fixed relative the connection with the arm 421, orbits the lever central axis in an offset circular path.

An actuator 460 is further provided. The actuator has a first end 461 and a second end 462. The actuator 460 further has a motor 463 and a linear shaft 464. In the preferred embodiment, the actuator 460 is an electrically powered actuator. The motor 463 is at the second end 462 of the actuator 460, and can be pivotally connected to the drag link 450 at a point intermediate the ends 451 and 452. The first end 461 of the actuator 460 is preferably pivotally connected to arm 427, or interface arm 427, of the lever. Further, the first end 461 of the actuator is slideably or movably received within track 430 between the first end 431 and second end 432. A roller can be provided for co-acting with the interface. Yet, it is understood that other embodiments can be utilized without departing from the broad aspects of the present invention. It is further understood that while the actuator 460 is shown in one orientation relative the drag link 450 and arm 427, that the opposite orientation (motor 463 near arm 427) could be utilized without departing from the broad aspects of the present invention.

A control arm 470 is provided. The control arm 470 has a first end 471 and a second end 472. The first end 471 is preferably pivotally and movably connected to the interface 456 in the ear 455 on the first end 451 of the drag link 450. The second end 472 is pivotally connected to end 461 of the actuator 460. The control arm 470 controls the location of the end 461 of the actuator 460 within the track 430, as described below.

A parallelogram 490 is partially defined by levers 420 and 440 and by drag link 450. The parallelogram is preferably comprised of theoretical lines drawn between connection points of the components, and not necessary comprised of the structure of the components themselves, respectively. The parallelogram 490 expands as the bed rises and collapses as the bed collapses. The deck 410 remains generally parallel to the floor during the expansion and collapse of parallelogram 490.

The second end 426 of arm 424 and the second end 446 of arm 444 are preferably pivotally connected to a base assembly 495, described below.

When the bed is collapsed, or in the low position, the control arm 470 dictates that the first end 461 of the actuator 460 be positioned at the second end 432 of the track 430. In this position, the effective length of arm 427 is maximized.

While the bed 405 is rising, the first end 461 of the actuator 460 slides in the track 430 away from end 432 and towards end 431. This shortens the effective length of arm 427 to increase the ratio of lift to stroke, and increase the speed of rotation of arms 421, 424 and 427 about the central axis. Increasing the ratio of lift to stroke maintains the output of the actuator near its peak capacity, and hence utilizes the actuator at or near peak efficiency.

It is appreciated that since the actuator 460 is connected to drag link 450, it is not directly connected to or fixed to the deck 410. Accordingly, the actuator 460 is a floating actuator.

It is also appreciated that the first end 461 of the actuator 460 can preferably continuously slide with track 430 as the bed 405 is being raised or lowered during the compression stage of the control arm 470. It is possible, but not required that the first end 461 of the actuator 460 slide within the track 430 at a constant rate while the control arm is in compression.

It is still further appreciated that the first end 471 of control arm 470 need not be movable within an interface. The control arm 470, being connected to the drag link, has an end 471 that will rotate at an offset distance about the central axis of lever 420 when in compression. Neither end 471 nor end 472 of the control arm 470 is fixed relative the deck 410 of the bed 405.

One preferred base assembly 495 has a first foot 496 and a second foot 497. The feet 496 and 497 can be any variety of castor bases. A support 498 is also provided, and can be a castor support that maintains spacing between foot 496 and foot 497.

Thus it is apparent that there has been provided, in accordance with the invention, a height adjustable apparatus that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A height adjustable apparatus comprising:

a deck;

a drag link;

a first lever, said first lever comprising:

a first lever first arm connected to said drag link;

a first lever second arm connected to and supporting said deck;

a first lever third arm comprising a first lever third arm interface, wherein said first lever first arm, said first lever second arm and said first lever third arm are stationary relative each other;

a second lever, said second lever comprising:

a second lever first arm connected to said drag link; and a second lever second arm connected to and supporting said deck, wherein said second lever first arm and said second lever second arm are stationary relative each other;

an actuator having an actuator first end and an actuator second end, wherein one of said actuator first end and said actuator second end is pivotally connected to said drag link, and the other of said actuator first end and said actuator second end is pivotally connected to said first lever third arm at said first lever third arm interface; and a control arm, said control arm having a control arm first end and a control arm second end, one of said control arm first end and said control arm second end being pivotally connected to said drag link, and the other of said control arm first end and said control arm second end controlling the location of said one of said actuator first end and said actuator second end relative said first lever third arm interface.

2. The height adjustable apparatus of claim 1 wherein the location on said drag link of the pivotal connection between said one of said control arm first end and said control arm second end and said drag link orbits a central rotational axis of said first lever.

3. The height adjustable apparatus of claim 2 wherein said orbit is defined as an offset circular path.

4. The height adjustable apparatus of claim 1 wherein said first lever second arm and said second lever second arm are connected to a base assembly.

5. The height adjustable apparatus of claim 2 wherein said drag link has an end with a drag link interface, said one of said control arm first end and said control arm second end being movable relative said drag link interface when said control ceases to be in compression.

6. The height adjustable apparatus of claim 5 wherein said drag link interface is a slot.

7. The height adjustable apparatus of claim 1 wherein:

said drag link is a first drag link, said control arm is a first control arm and said actuator is a first actuator; and said height adjustable apparatus further comprises:

a second drag link;

a third lever comprising:

a third lever first arm connected to said second drag link; and a third lever second arm, wherein said third lever first arm and said third lever second arm are stationary relative each other;

a fourth lever comprising:

a fourth lever first arm connected to said second drag link;

a fourth lever second arm; and a fourth lever third arm comprising a fourth lever third arm interface, wherein said fourth lever first arm, said fourth lever second arm and said fourth lever third arm are stationary relative each other;

a second actuator having a second actuator first end and a second actuator second end, wherein one of said second actuator first end and said second actuator second end is pivotally connected to said second drag link, and the other of said second actuator first end and said second actuator second end is pivotally connected to said fourth lever third arm at said further lever third arm interface;

a second control arm, said second control arm having a second control arm first end and a second control arm second end, one of said second control arm first end and said second control arm second end being pivotally connected to said second drag link, and the other of said second control arm first end and said second control arm second end controlling the location of said one of said second actuator first end and said second actuator second end relative said fourth lever third arm interface; and castors supporting said height adjustable apparatus on a floor, whereby extension of said first actuator and said second actuator cause said deck to raise relative said castors in a plane that is generally parallel to the floor.

8. The height adjustable apparatus of claim 7 wherein:

said first actuator and said second actuator act in series;

said first drag link, said first lever, said second lever and said second drag link define a first parallelogram, said first parallelogram being expandable in a first orientation; and said second drag link, said third lever, said forth lever and said castors define a second parallelogram, said second parallelogram being expandable in a second orientation that is generally opposed to said first orientation.

9. The height adjustable apparatus of claim 7 wherein the location on said second drag link of the pivotal connection between said one of said second control arm first end and said second control arm second end and said second drag link orbits a central rotational axis of said fourth lever in an offset circular path.

10. The height adjustable apparatus of claim 1 wherein:

said apparatus is movable from a low position to a high position;

said first lever third arm interface comprises a first lever third arm slot having a first lever third arm slot first end and a first lever third arm slot second end;

said drag link comprises a drag link interface having a drag link interface slot having a drag link interface slot first end and a drag link interface slot second end;

at the low position, said control arm second end is at said first lever third arm slot second end and said control arm first end is at said drag link interface slot first end;

moving from the low position toward the high position, said control arm is first in compression as said control arm second end moves towards said first lever third arm slot first end;

when said control arm ceases to be compression, said control arm first end is unrestrained within said drag link interface; and at a high position, said control arm second end is at said first lever third arm slot first end and said control arm first end is at said drag link interface slot second end.

* * * * *